US009424827B2

(12) United States Patent
Gill et al.

(10) Patent No.: US 9,424,827 B2
(45) Date of Patent: Aug. 23, 2016

(54) ELECTRONIC PERCUSSION INSTRUMENT WITH ENHANCED PLAYING AREA

(71) Applicant: inMusic Brands, Inc., Cumberland, RI (US)

(72) Inventors: David C. Gill, North Providence, RI (US); Adam Cohen, Norton, MA (US)

(73) Assignee: inMusic Brands, Inc., Cumberland, RI (US)

( * ) Notice: Subject to any disclaimer, the term of this patent is extended or adjusted under 35 U.S.C. 154(b) by 91 days.

(21) Appl. No.: 14/297,176

(22) Filed: Jun. 5, 2014

(65) Prior Publication Data

US 2015/0294658 A1 Oct. 15, 2015

Related U.S. Application Data

(60) Provisional application No. 61/979,419, filed on Apr. 14, 2014.

(51) Int. Cl.
*G10H 3/12* (2006.01)
*G10H 3/14* (2006.01)

(52) U.S. Cl.
CPC ..... *G10H 3/12* (2013.01); *G10H 3/146* (2013.01); *G10H 2230/275* (2013.01); *G10H 2230/281* (2013.01)

(58) Field of Classification Search
CPC ..... G10H 3/12
USPC ..... 84/723, 743
See application file for complete search history.

(56) References Cited

U.S. PATENT DOCUMENTS

| | | | | |
|---|---|---|---|---|
| 4,226,156 | A * | 10/1980 | Hyakutake | G10H 3/146 84/411 M |
| 4,947,725 | A * | 8/1990 | Nomura | G10D 13/024 84/723 |
| 5,042,356 | A * | 8/1991 | Karch | G10D 13/024 84/104 |
| 5,293,000 | A * | 3/1994 | Adinolfi | G10D 13/024 84/730 |
| 5,396,024 | A * | 3/1995 | Noguchi | G10D 13/024 84/730 |
| 5,920,026 | A | 7/1999 | Yoshino et al. | |
| 7,385,135 | B2 | 6/2008 | Yoshino et al. | |
| 9,006,555 | B2 * | 4/2015 | Mori | G10H 3/14 84/104 |
| 2005/0150366 | A1 * | 7/2005 | Susami | G10H 3/146 84/735 |
| 2014/0069265 | A1 * | 3/2014 | Shih | G10H 1/32 84/730 |
| 2015/0027301 | A1 * | 1/2015 | Shih | G10H 3/12 84/730 |
| 2015/0294658 | A1 * | 10/2015 | Gill | G10H 3/12 84/723 |

* cited by examiner

*Primary Examiner* — David Warren
(74) *Attorney, Agent, or Firm* — Finnegan, Henderson, Farabow, Garrett & Dunner, LLP

(57) ABSTRACT

Electronic percussion instruments with enhanced playing areas and methods and systems for generating electrical signals in response to impacts to a playing surface are disclosed. A semi-permeable playing surface covering an acoustic noise reducing cavity of an electronic percussion instrument may receive an impact within a predefined impact region, and an electrical signal may be generated in response by an electromechanical sensor that senses the impact. In many instances, the generated electrical signal may be configured to be equivalent in magnitude to any other electrical signal generated by the electromechanical sensor, in response to any other received impact within the same predefined impact region.

19 Claims, 24 Drawing Sheets

ELECTRONIC PERCUSSION INSTRUMENT WITH ENHANCED PLAYING AREA

CROSS-REFERENCE TO RELATED APPLICATIONS

The present application claims the benefit of priority of U.S. Provisional Application No. 61/979,419, filed Apr. 14, 2014, entitled "ELECTRONIC PERCUSSION INSTRUMENT WITH ENHANCED PLAYING AREA," the disclosure of which is expressly incorporated herein by reference in its entirety.

FIELD

The present disclosure relates generally to electronic percussion instruments with enhanced playing areas and methods and systems for generating electrical signals using the same.

BACKGROUND AND DESCRIPTION

Traditionally, electronic percussion instruments (e.g., electronic drums) comprise a head (e.g., playing surface), composed of mesh, Mylar, or rubber material, attached to a housing (i.e., shell or cavity) and one or more sensors. The playing surface is usually made of a thin mesh (woven material), Mylar, or rubber material, and has an inferior end (i.e., bottom side) and a superior end (i.e., top side). The sensor typically comprises a flexible cushion material that is in contact with the inferior end of the playing surface mounted in the center of the drum, and an electromechanical transducer (piezoelectric transducer) positioned between the flexible cushion material and a supporting structure that is attached to the inner shell of the electronic percussion instrument. The supporting structure is generally a thin rigid material that is used to support the sensor.

Electronic percussion instruments are designed to transfer vibrations, induced by a user striking the superior end of a playing surface, to a flexible cushion material that is coupled to an electromechanical transducer that generates electrical signals in response to vibrations. These solutions are designed to give a varying electrical signal that can be interpreted by a drum module to determine how hard the surface was struck (i.e., magnitude). In some embodiments, a drum module can determine the magnitude and/or the location of the strike. The magnitude of the electrical signal (i.e., the amplitude of the velocity and/or force of the electrical signal) is determined by the shape, size, and location of the flexible cushion material, the sensor, and components (e.g., sensor plate) within the sensor. It is also determined by the location of the superior end of the playing surface that has been struck. Some modules may use the location and magnitude information to play different sounds or alterations to the current sound.

In many electronic percussion instruments, the flexible cushion material has a frustoconical shape, and the area of the flexible cushion material is considerably smaller than the entire area of the playing surface. The flexible cushion material is usually located in the center of the shell, and the superior end of the flexible cushion material is in contact with the inferior end of the playing surface. In such an orientation, a strike to the center of the superior end of the playing surface just above the flexible cushion material will cause the electromechanical transducer to generate an electrical signal with a magnitude that is greater than the magnitude of a signal corresponding to a strike further away from the center of the playing surface. Therefore, the sensitivity (i.e., magnitude of an electrical signal generated by an electromechanical transducer in response to a strike to a playing surface) is greater in the middle of the playing surface, as opposed to an area between the center and the perimeter of the playing surface. Thus, the area of the playing surface with the greatest sensitivity (i.e., sweet spot) is the area directly above the flexible cushion material. In most modern electronic percussion instruments, the area of the flexible cushion material is very small, thereby requiring a user to strike the superior end of the playing surface directly above the cushion material in order to generate a certain consistent sound. This design is appropriate for advanced users who are familiar with the sensitivity of a playing surface. However, novice and/or beginning users who are unfamiliar with the different areas of the playing surface, or have a lower degree of control or playing technique, have a harder time locating the sweet spot consistently. Existing designs make it difficult for novices and beginners to determine which area(s) of the playing surface should be struck in order to produce different sounds consistently.

An alternative design may enable a user to adjust the area of the sweet spot, thus enabling an electronic percussion instrument to reproduce a similar sound across a larger area of the playing surface. Multiple flexible cushion materials and electromechanical transducers of varying shapes and sizes can be used to adjust (i.e., increase or decrease) the area of sensitivity, thereby enabling an electronic percussion instrument to generate the same sound when a user strikes a portion of a playing surface corresponding to the adjusted area of sensitivity. By increasing the sweet spot, a user can strike the playing surface in a location that is not exactly at the center of the playing surface, and the electronic percussion instrument will produce the same sound that would be produced if the user struck the center of the playing surface. Conversely, as a user becomes more proficient at striking the playing surface in a sweet spot of a larger area, the user can reduce the area of the sweet spot thereby enabling a user to focus on striking different areas of a playing surface that correspond to an electronic percussion instrument producing different sounds.

Existing electronic percussion instruments are designed to generate differences in sensitivity levels across a playing surface due to the central location of a single flexible cushioning material. The present disclosure describes an electronic percussion instrument that can enable a user to adjust the differences in sensitivity levels across a playing surface, as well as maintain a constant sensitivity level across the entire playing surface.

SUMMARY

In one disclosed embodiment, a method for generating an audio signal from an electronic percussion instrument using a semi-permeable playing surface, noise reducing acoustic cavity, and electromechanical sensor is disclosed. The method comprises receiving an impact to the playing surface covering an acoustic cavity of the electronic percussion instrument, and transferring the impact to the shock absorbing posts that are communicatively coupled to the playing surface. The method further comprises transferring the impact received at the shock absorbing posts to the plate that is communicatively coupled to the shock absorbing posts, transferring the impact received at the plate to the electromechanical transducer that is communicatively coupled to the plate, and generating an audio signal, in response to the received impact, at the electromechanical transducer that is equivalent to the magnitude of the impact.

In another disclosed embodiment, an electronic percussion instrument is provided. The electronic percussion instrument includes an acoustic noise reducing cavity, a semi-permeable playing surface comprising connected strands of ductile material configured to cover the acoustic noise reducing cavity, and an electromechanical sensor configured to sense an impact to the semi-permeable playing surface. The electromechanical sensor is configured to sense an impact received within a predefined impact region of the semi-permeable playing surface, and to generate an electrical signal associated with the sensed impact, wherein the generated electrical signal is equivalent in magnitude to any other electrical signal generated by the sensor in response to any other received impact within the predefined impact region.

DETAILED DESCRIPTION

Figure 1:
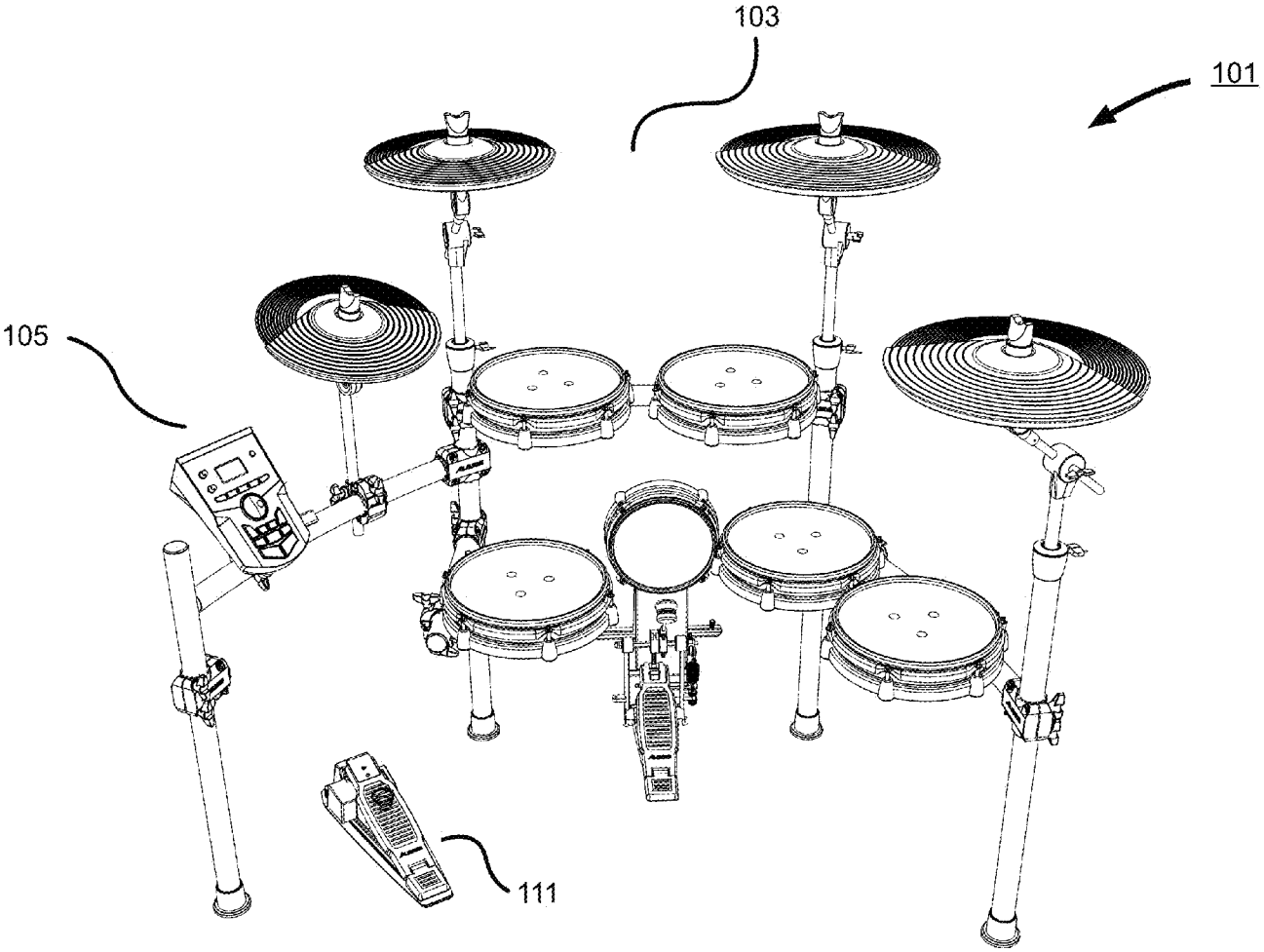
FIG. 1 is a diagram illustrating an exemplary electronic percussion instrument system for producing a percussion sound, consistent with some of the embodiments of the present disclosure.

The present disclosure relates generally to methods and systems for generating acoustic, synthetic, and electronic drum sounds with the same timbre and/or intensity when a playing surface of an electronic percussion instrument is struck within a predefined area. In some embodiments, a voice or synthesized sound can be generated when a user strikes the playing surface. When a user, such as a musician, is not familiar with a playing surface of a particular electronic percussion instrument, he/she usually has to spend time either tuning the electronic percussion instrument, or learning about the different areas of the playing surface that should be struck in order to generate—particular sounds. A musician can therefore spend a considerable amount of time tuning a playing surface on an electronic percussion instrument in order to generate a sound with a certain timbre. An experienced musician can adjust the settings on an electronic percussion instrument quickly, but a beginner or even an intermediate musician might not be familiar enough with the settings, thereby requiring hours, or even days of learning in order to appropriately adjust the settings. Beginners also might not have the required skills or technique to consistently strike the proper area of the playing surface, thus requiring an electronic percussion instrument that can reproduce the same sound regardless of where a user strikes the playing surface. An electronic percussion instrument with a playing surface that can be struck in any location and generate a sound with the same timbre and/or intensity, shifts the responsibility of tuning an electronic percussion instrument from the musician to the electronic percussion instrument itself. An electronic percussion instrument with this feature enables a musician to spend more time learning how to play an electronic percussion instrument instead of adjusting the settings in order to produce an appropriate sound.

Methods and systems described herein enable electronic percussion instruments to generate a similar sound when a user strikes multiple regions of a playing surface of an electronic percussion instrument with a certain force. In general, the disclosure utilizes novel sensors that can be comprised of smart materials that may be combined and oriented with respect to one another in certain arrangements to increase or decrease the effective surface area of a playing surface of an electronic instrument over which the electronic percussion instrument can produce sounds that are the same.

Electronic percussion instruments disclosed herein may comprise a playing surface composed of one or more mesh, Mylar, and/or other elastic materials that reduce acoustic sounds within the electronic percussion instrument, when a user strikes the playing surface. A playing surface composed of mesh material can be woven in one or more different orientations. Electronic percussion instruments disclosed herein further comprise sensors comprising one or more shock absorbing materials and transducers, and a shell that may contain an anechoic chamber for reducing reverberations from acoustic waves generated by a playing surface when a user strikes the playing surface.

Sensors disclosed herein may be composed of one or more flexible shock absorbing materials, rigid plates, and/or electromechanical transducers that may be in contact with a playing surface of an electronic percussion instrument. The sensors may convert vibrations within a playing surface, induced by an impact to the playing surface, to an electrical signal that can be used by an electronic drum module to generate a musical tone or sound. Depending on the size, shape, and orientation of a sensor, an electromechanical transducer can generate similar or exactly the same electrical signal for impacts to certain predefined regions of a playing surface.

In some embodiments, components of a sensor may be arranged such that the magnitude of electrical signals generated by an electromechanical transducer in response to impacts of the same force across a playing surface is different at each location a user strikes a playing surface. This embodiment can enable a user to experience what it is like to play on an acoustic drum, because each point on the playing surface of an acoustic drum produces a unique acoustic sound.

In other embodiments, components of a sensor may be arranged such that the magnitude of electrical signals generated by an electromechanical transducer is approximately the same in response to impacts of the same force across a predefined area of a playing surface that does not encompass the entire playing surface. Such an embodiment can enable an electromechanical transducer to generate electrical signals of similar magnitude for impacts of the same force to these regions. Such an embodiment can help an intermediate or novice user learn which portions of a playing surface should be struck in order to induce an electromechanical transducer to generate a certain electrical signal.

In yet other embodiments, components of a sensor may be arranged such that the magnitude of electrical signals generated by an electromechanical transducer can be exactly the same in response to impacts of the same force, across an entire playing surface. Such an embodiment can enable an electromechanical transducer to generate electrical signals of exactly the same magnitude for impacts of the same force regardless of where a user strikes a playing surface. Such embodiments may help a user to focus on playing an electronic percussion instrument, rather than tuning it to generate a particular sound.

In yet another embodiment, one or more sensors may be used such that the magnitude of the electrical signals generated by one or more electromechanical transducers can be adjusted to be exactly the same, equivalent (i.e., similar but not exactly the same), or very different depending on a user's preference. If sensors are oriented concentrically, a user may decide to adjust the sensors such that the magnitude of the sensors increases from the center of the electronic percussion instrument to the edge of the electronic percussion instrument, or vice versa. Alternatively, a user may adjust the sensors such that any permutation and/or combination of sensitivity levels can be implanted. For example, two sensors may have exactly the same sensitivity level, but may be separated by a sensor that has a different sensitivity level. A user is thereby able to customize the magnitude of an electrical signal, and therefore the timbre of a musical tone, by adjusting the sensitivity of the sensors.

Furthermore, the present disclosure may be characterized by an electronic percussion instrument system that detects a strike to a playing surface of an electronic percussion instrument, generates a corresponding electrical signal that can be used to generate a musical tone, or sound based on certain properties of the electrical signal, and outputs the musical tone, or sound to a speaker or other output device.

The following detailed description refers to the accompanying drawings. Wherever possible, the same reference numbers are used in the drawings and the following description to refer to the same or similar parts. While several example embodiments are described herein, modifications, adaptations, and other implementations are possible. For example, substitutions, additions, or modifications may be made to the components illustrated in the drawings. The example methods described herein may be modified by removing, substituting, reordering, or adding steps to the disclosed methods. Accordingly, the foregoing general description and the following detailed description are exemplary only, and are not limiting.

In addition, numerous specific details are set forth in order to provide a thorough understanding of the exemplary embodiments described herein. However, it will be understood by those of ordinary skill in the art that these embodiments may be practiced without all the specific details. Furthermore, well-known methods, procedures and components have not been described in detail so as not to obscure the exemplary embodiments described herein.

A single form of a term in this disclosure includes the terms' plural form, and vice versa. The indefinite article (a or an) and the definite article (the), when used in the specification and claims, is meant to include one or more of the objects, activities or steps than it might qualify, unless otherwise expressly indicated to the contrary. For example, "a" sensor can be one or more than one sensor.

FIG. 1 shows a diagram illustrating an exemplary electronic percussion instrument system for producing percussion sounds, consistent with the embodiments of the present disclosure. Electronic percussion instrument system 101 can be comprised of electronic percussion instruments 103 and drum module 105. Electronic percussion instruments 103 may comprise one or more electronic percussion instruments as described herein.

Drum module 105 may be a device that receives electrical signals from percussion instruments 103, and output one or more sounds. Drum module 105 may include at least one processor, which controls the operation of drum module 105.

Processors included in drum module 105 may be, for example, a single microprocessor, multiple microprocessors, field programmable gate arrays (FPGAs), or digital signal processors (DSPs) capable of executing particular sets of instructions. The instructions executed on the processors can include instructions that enable drum module 105 to produce a set of sounds that are selectable by a user to be triggered when a user strikes electronic percussion instruments 103. In some embodiments, the instructions can be preprogrammed sounds or tones that can be edited or modified by a user. In other embodiments, a user can create the instructions.

Figure 2:
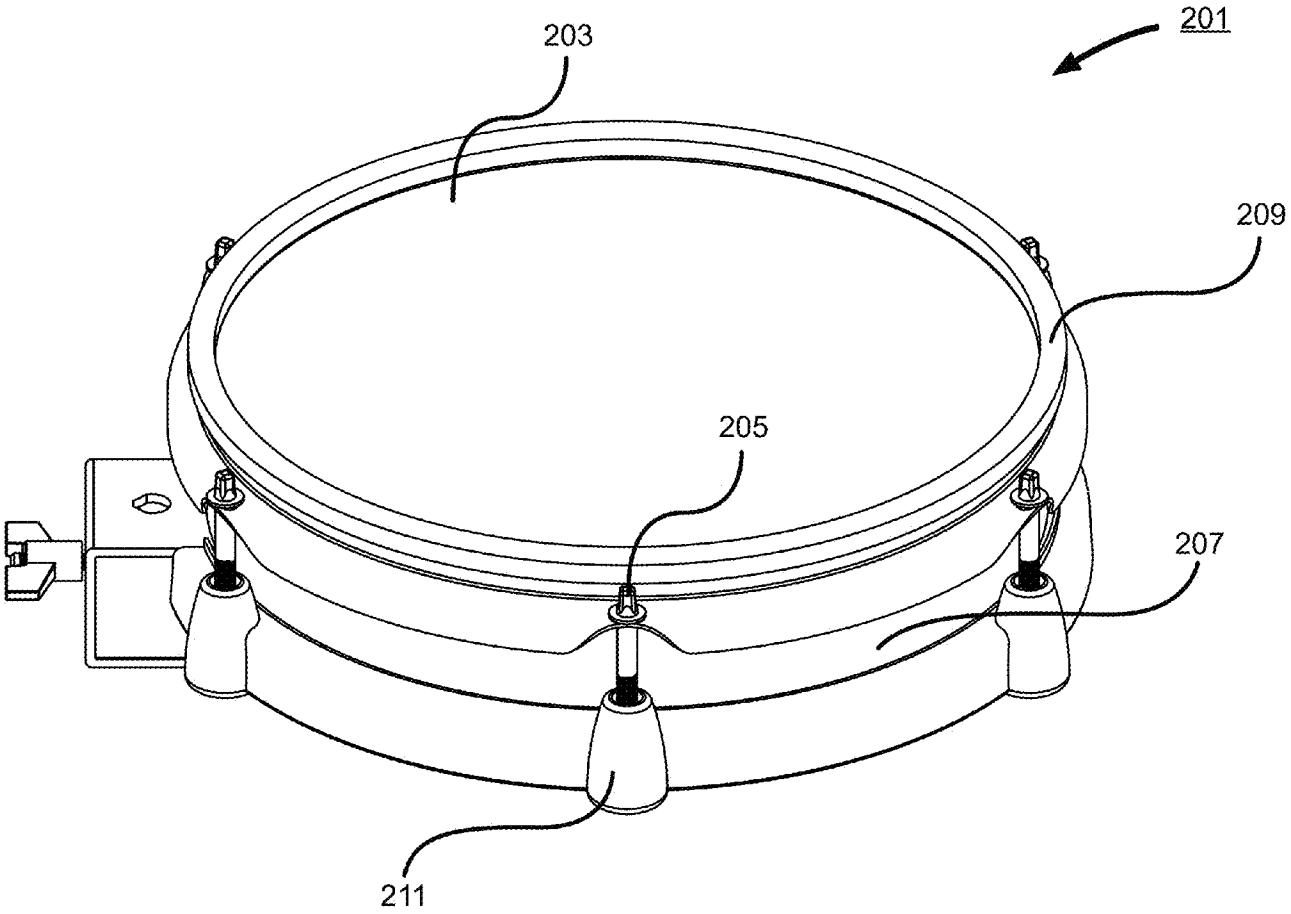
FIG. 2 is an exemplary image of the outside of an electronic percussion instrument, consistent with some of the embodiments of the present disclosure.

FIG. 2 is an exemplary image of the outside of an electronic percussion instrument, consistent with some of the embodiments of the present disclosure. Electronic percussion instrument 201 may be comprised of playing surface 203, tuning rod 205, shell 207, rim 209, and nut boxes 211. Nut boxes 211 may have a tapped hole with a threaded groove configured to receive tuning rods 205 that are screwed into nut boxes 211. Tuning rods 205 may be screwed into nut boxes 211 to secure playing surface 203 and rim 209 to shell 207.

Playing surface 203 may be composed of materials such as mesh, Mylar, or rubber. In some embodiments, playing surface 203 may generate no sound when struck by a user. In other embodiments, playing surface 203 may generate a variety of sounds when struck by a user. Playing surface 203 may be an elastic membrane of uniform thickness attached to rim 209. The elastic membrane can comprise a plurality of strands composed of ductile material. The strands can be woven together to form a lattice structure. The lattice structure can comprise a plurality of lattice cells, wherein each lattice cell can comprise a plurality of intersecting strands of ductile material. The area between the internal edges of the intersecting strands can form an opening through which mechanical waves (e.g., sound waves), induced by a user striking the elastic membrane, can be transferred to the inside of electronic percussion instrument 201. In some embodiments, the strands of the lattice cell can be woven together in such a way so as to reduce the number of sound waves transferred to the inside of electronic percussion instrument 201. For example, increasing the number of intersecting strands in a lattice cell can reduce the intensity of the sound waves transferred to the inside of electronic percussion instrument 201, while preserving the same reverberation properties (i.e., restoring forces) of an acoustic drum playing surface.

Tuning rods 205 may be rotated clockwise or counter clockwise to increase or decrease the tension of playing surface 203. In some embodiments, increasing or decreasing the tension in playing surface 203 adjusts the pitch and resonance of electronic percussion instrument 201. For example, increasing tension in playing surface 203 may result in playing surface 203 generating smaller vibrations when a user strikes the surface, thereby producing smaller resonances. Conversely, when tension in playing surface 203 is decreased, playing surface 203 may generate larger vibrations thereby producing larger resonances. Therefore, in some embodiments, adjusting the tension in playing surface 203 may change the output signal generated by speaker a speaker connected to drum module 105, as a result of a user striking playing surface 203.

In other embodiments an output signal generated by a speaker, as a result of a user striking playing surface 203, can be changed by hardware and software components within drum module 105. Drum module 105 can generate an electronic tone, when a user strikes playing surface 203, that corresponds to an electrical signal that can be generated by drum module 105, after adjusting the tension in playing surface 203. For instance, if playing surface 203 is adjusted to a certain tension level, and a user strikes playing surface 203, drum module 105 can output an electronic tone to a speaker. Alternatively, the tension level in playing surface 203 might not be adjusted, and drum module 105 may output the same electronic tone to a speaker when a user strikes playing surface 203, by modifying the signal received from electronic percussion instrument 201. In some embodiments, drum module 105 may modify a signal received from electronic percussion instrument 201, and output an electrical signal to a speaker that corresponds to increasing or decreasing the tension in playing surface 203. Therefore, drum module 105 may generate a plurality of tones corresponding to different tensions in playing surface 203 without the tensions in playing surface 203 being adjusted.

Figure 3:
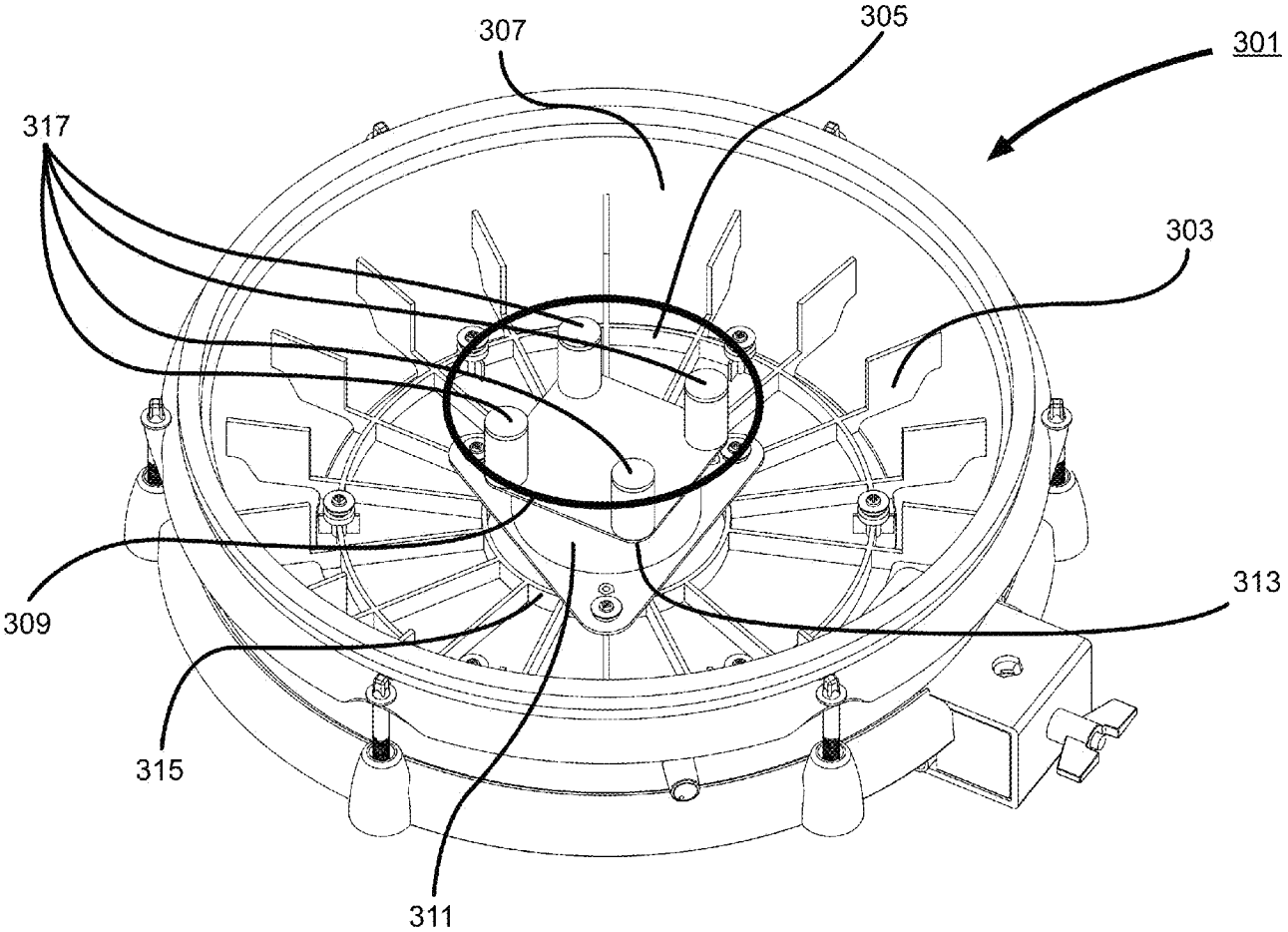
FIG. 3 is an exemplary image of the inside of an electronic percussion instrument, consistent with some of the embodiments of the present disclosure.

FIG. 3 is an exemplary image of the inside of an electronic percussion instrument, consistent with some embodiments of the present disclosure. Electronic percussion instrument 301 may be comprised of one or more flanges 303 extending from sensor enclosure 305 to the perimeter of the interior of shell 307. Flanges 303 may be composed of plastic, metal, a hybrid of plastic and metal, and/or other materials. In some embodiments the orientation and quantity of flanges 303 may modify the acoustic waves generated by a user striking a playing surface (not shown). Flanges 303 may be used to strengthen electronic percussion instrument 301, and to absorb sound waves, thereby reducing echoes produced by the inside of electronic percussion instrument 301 when a user strikes a playing surface. In some embodiments, flanges 303 may be used to create an anechoic chamber (i.e., echo-free chamber) within electronic percussion instrument 301. Therefore, the quantity and orientation of flanges 303 may create an echo-free chamber, thereby enabling electronic percussion instrument 301 to produce no sound when a user strikes a playing surface.

Sensor enclosure 305 may comprise sensor 309, dampening material 311, and plate 313. Sensor 309 can be affixed to dampening material 311, and dampening material 311 can be affixed to plate 313. Dampening material 311 may be composed of rubber or other pliable material. Plate 313 may be metal or plastic, and may be affixed to the bottom of the interior of shell 307. Sensor 309 may be affixed to dampening material 311 by one or more screws, bolts, binding chemicals, and/or any combination of the aforementioned. Dampening material 311 may be affixed to plate 313 by one or more screws, bolts, binding chemicals, and/or any combination of the aforementioned. Plate 313 may be affixed to the bottom of the interior shell 307 by one or more screws, bolts, binding chemicals, and/or any combination of the aforementioned. The exterior 315 of sensor enclosure 305 can reflect acoustic waves away from sensor 309 when a user strikes a playing surface (not shown). Sensor enclosure 305 may reflect acoustic waves away from sensor 309, so that sensor 309 does not absorb any acoustic waves generated when a user strikes a playing surface. Absorption of acoustic waves by sensor 309 can affect the ability of sensor 309 to sense vibrations from a playing surface when vibrations from a playing surface are transferred to sensor 309 by shock absorbing posts 317. Sensor enclosure 305 may have a conical, square, triangular, and/or other shape that maximizes the reflectance of acoustic waves away from sensor 309. In some embodiments the shape of sensor enclosure 305 may be determined by the magnitude (e.g., amplitude, phase, frequencies, and/or velocity) of the acoustic waves reflected by the interior of shell 307, when a user strikes a playing surface. The thickness of sensor enclosure 305 may be determined by the magnitude of acoustic waves generated by the interior of shell 307. For instance, the thickness of enclosure 305 may be determined by the frequencies of acoustic waves that can be generated by the interior of shell 307 after a user has struck a playing surface. The thickness of sensor enclosure 305 may increase as the range of frequencies that may be generated by the interior of shell 307 increases. For example, sensor enclosure 305 can be a first thickness corresponding to a first frequency produced by the interior of shell 307, or a second thickness, greater than the first thickness, if a second frequency is greater than the first frequency.

Figure 4:
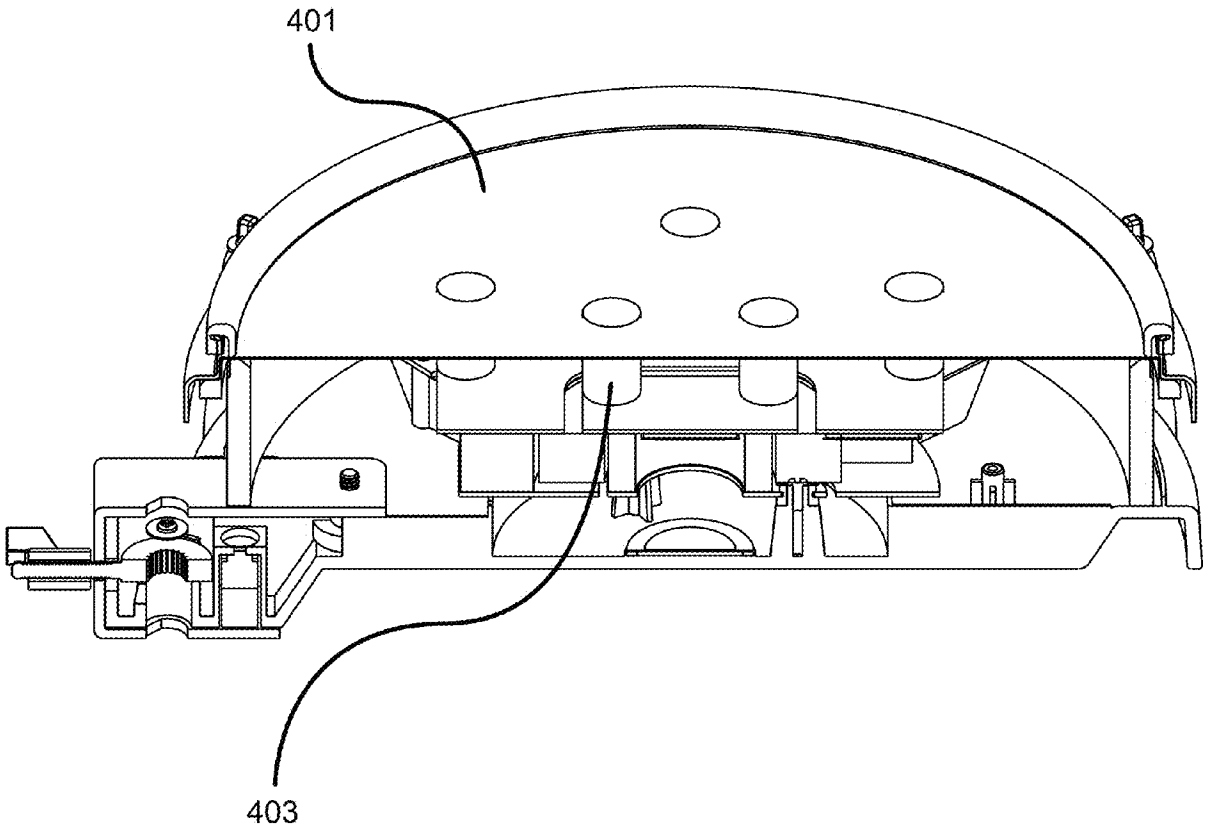
FIG. 4 is an exemplary image of a cross-sectional view of an electronic percussion instrument, consistent with some of the embodiments of the present disclosure.

FIG. 4 is an exemplary image of a cross-sectional view of an electronic percussion instrument, consistent with some embodiments of the present disclosure. The inferior end of playing surface 401 may be in contact with the superior end of shock absorbing posts 403. When a user strikes playing surface 401, the vibrations generated by playing surface 401 may be transferred to shock absorbing posts 403.

Figure 5:
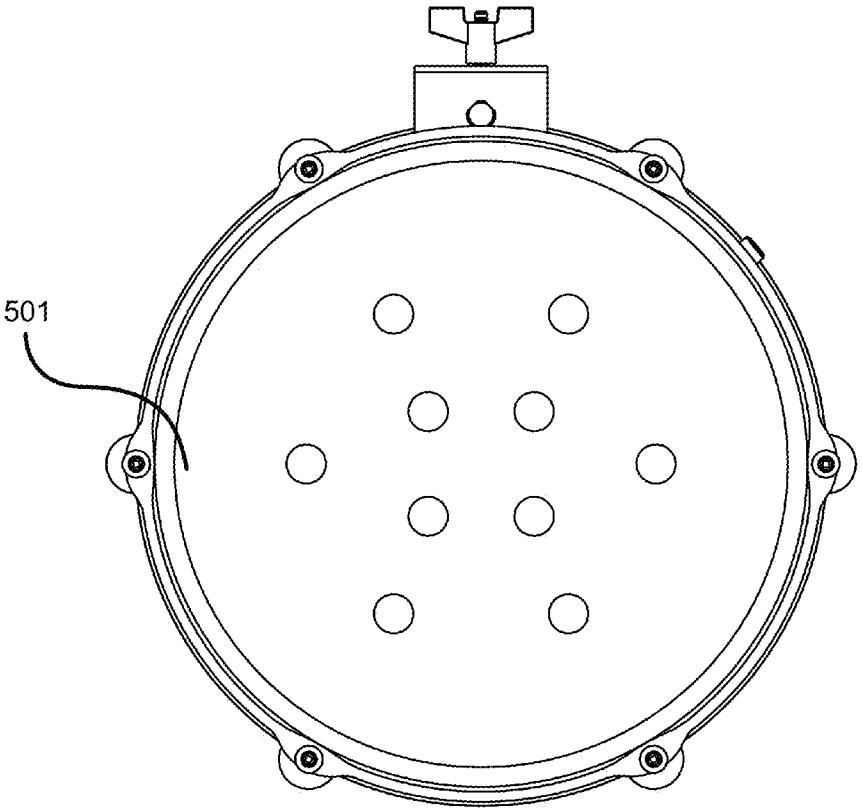
FIG. 5 is an exemplary image of a playing surface on an electronic percussion instrument, consistent with some of the embodiments of the present disclosure.

FIG. 5 is an exemplary image of a playing surface on an electronic percussion instrument, consistent with some embodiments of the present disclosure. Playing surface 501 may be composed of a mesh, Mylar, rubber, and/or other flexible material. The inferior end of playing surface 501 may be in contact with the superior end of shock absorbing posts (not shown).

Figure 6:
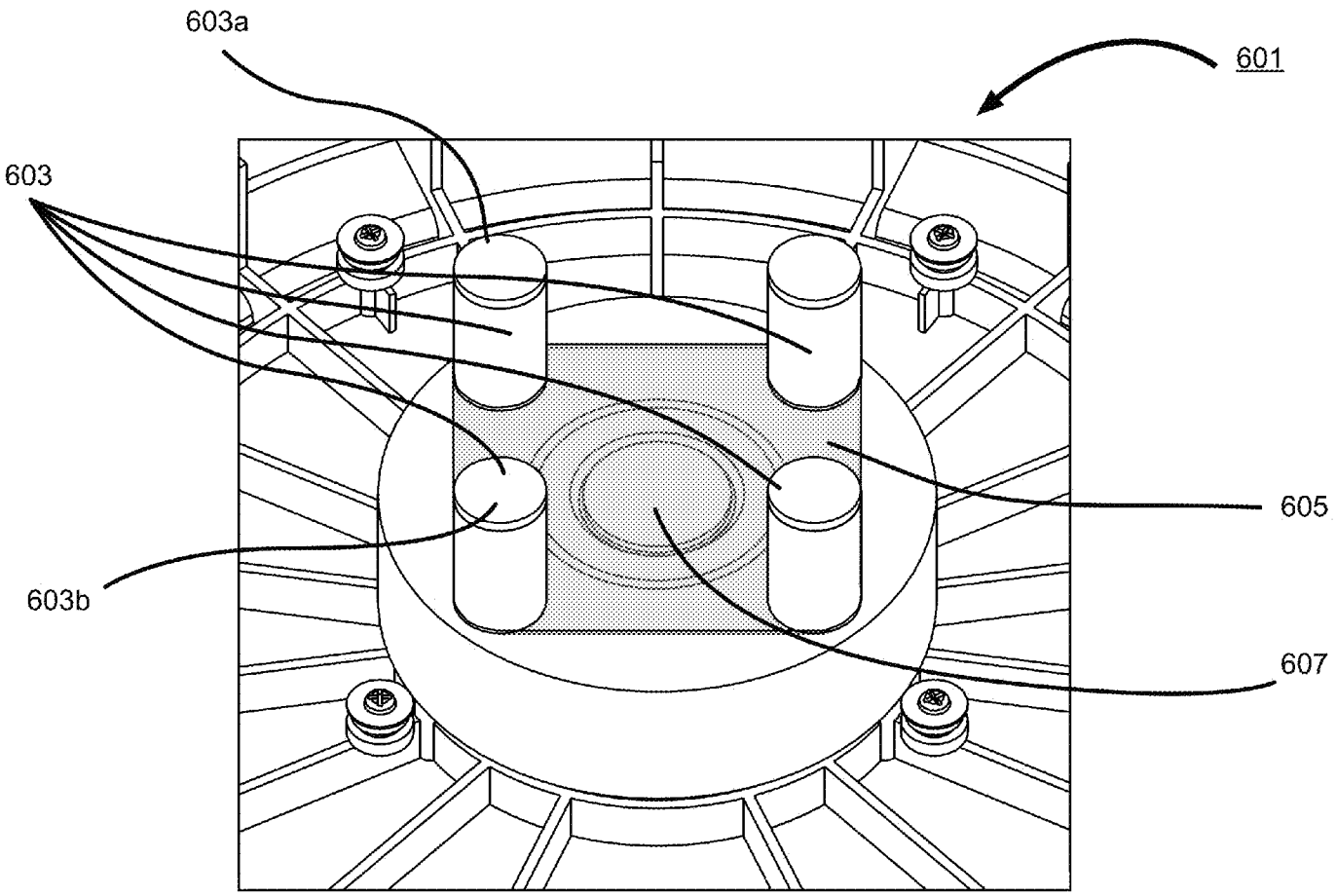
FIG. 6 is an exemplary image of a sensor, consistent with some of the embodiments of the present disclosure.

FIG. 6 is an exemplary image of a sensor, consistent with some embodiments of the present disclosure. Sensor 601 may be composed of shocking absorbing posts 603, plate 605, and electromechanical transducer 607. The superior end of shock absorbing posts 603 may be in contact with the inferior end of a playing surface (not shown). When a user strikes a playing surface, the vibrations generated in the playing surface may be transferred to shock absorbing posts 603. The vibrations in shock absorbing posts 603 may cause plate 605 to vibrate, which may cause electromechanical transducer 607 to vibrate. Electromechanical transducer 607 may generate an electrical signal in response to the vibrations induced.

Electromechanical transducer 607 may generate different electrical signals depending on the force with which a user strikes a playing surface. For example, if a playing surface is struck in the center of shock absorbing posts 603 with a first force that is greater than a second force, electromechanical transducer 607 may produce a first electrical signal that has a greater velocity than a second electrical signal. In some embodiments, the amplitude of a first electrical signal may be greater than the amplitude of a second electrical signal, if the force corresponding to the first electrical signal is greater than the force corresponding to the second electrical signal. In other embodiments, the phase of a first electrical signal can be different (e.g., larger or smaller) than the phase of a second electrical signal, if the force corresponding to the first electrical signal is greater than the force corresponding to the second electrical signal.

Electromechanical transducer 607 may generate different electrical signals depending on the location of a strike on a playing surface. The area of plate 605 may be equivalent to the area of electromechanical transducer 607. In such a case, if a user strikes any area of a playing surface within shock absorbing posts 603, with the same force, electromechanical transducer 607 may produce the same electrical signal. For instance, if a playing surface is struck directly above shock absorbing post 603*a*, electromechanical transducer 607 may produce an electrical signal with a magnitude (e.g., size of the velocity) that is equivalent to the magnitude associated with an electrical signal that is produced when the playing surface is directly struck above shock absorbing post 603*b*. Therefore, in some embodiments, the velocity of an electrical signal produced by electromechanical transducer 607 is the same whenever a playing surface is struck within the area directly above plate 605.

If a playing surface is struck in an area that is not directly above plate 605, the magnitude of an electrical signal generated by electromechanical transducer 607 may not be the same as the magnitude of an electrical signal corresponding to a playing surface struck directly above plate 605. However in some embodiments, it is possible for electromechanical transducer 607 to produce electrical signals of the same magnitude, independent of where a user strikes a playing surface. For example, electromechanical transducer 607 may generate a first electrical signal with a first velocity, in response to a first force applied to the center of shock absorbing posts 603, that is equal to a second velocity associated with a second electrical signal corresponding to a second force applied to the circumferential edge of the playing surface, if the second force is greater than the first force. Therefore, the force required to generate an electrical signal with the same velocity may increase as the radial distance between the center of shock absorbing posts 603 and the circumferential edge where a user applies a force to a playing surface increases.

Figure 7:
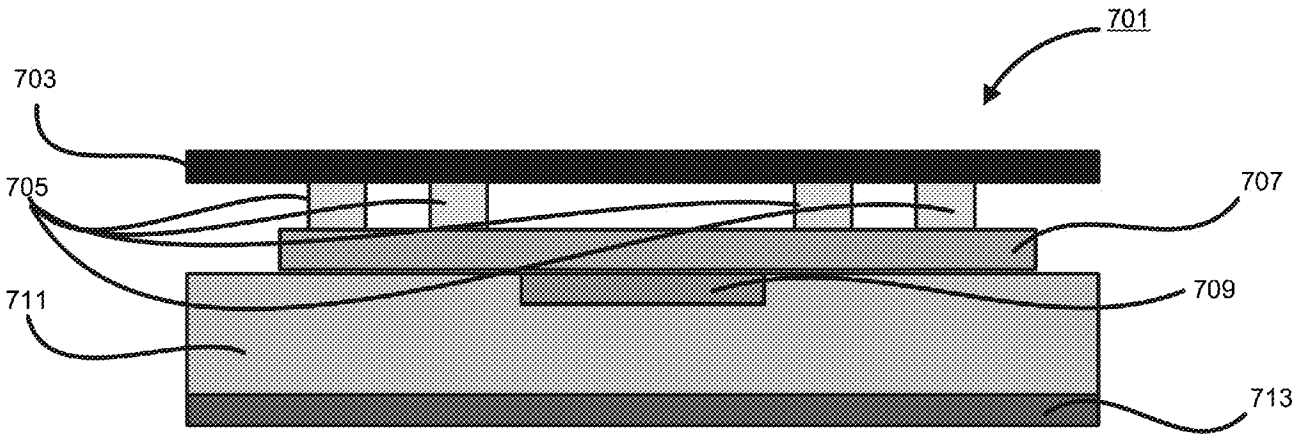
FIG. 7 is a diagram illustrating an exemplary cross-sectional view of a sensor inside an electronic percussion instrument, consistent with some of the embodiments of the present disclosure.

FIG. 7 shows a diagram illustrating an exemplary cross-sectional view of a sensor inside an electronic percussion instrument, consistent with some embodiments of the present disclosure. Electronic percussion instrument 701 may be comprised of playing surface 703, shock absorbing posts 705, plate 707, electromechanical transducer 709, dampening material 711, and structural body 713. The superior end of shock absorbing posts 705 may be in contact with the inferior end of playing surface 703.

Plate 707 may be composed of plastic, metal, and/or another hard/rigid material. The superior end of plate 707 may be in contact with the inferior end of shock absorbing posts 705. Plate 707 may transfer vibrations, induced by a user striking playing surface 703, to electromechanical transducer 709 via shock absorbing posts 705.

Electromechanical transducer 709 may be a piezoelectric sensor comprised of a crystalline structure that may produce electrical signals in response to vibrations (e.g., strain or stress) within the crystalline structure. The superior end of electromechanical transducer 709 may be in contact with the inferior end of plate 707.

Dampening material 711 can be composed of the same material that dampening material 311 is composed of, and may be used to dampen vibrations generated by forces applied by a user to playing surface 703. Dampening material 711 can be used to prevent seismic and/or acoustic waves from being produced, within electronic percussion instrument 701, that can perturb electrical signals generated by electromechanical transducer 709. For example, when a user strikes playing surface 703, dampening material 711 can reduce the impact of seismic and/or acoustic waves on electromechanical transducer 709 by absorbing seismic and/or acoustic waves reflected from the edges of electronic percussion instrument 701. The superior end of dampening material 711 may be in contact with the inferior end of electromechanical transducer 709.

Structural body 713 can be composed of plastic, metal, or another hard/rigid material. Structural body 713 can be used as a raised platform upon which the aforementioned components can be supported. The superior end of structural body 713 may be in contact with the inferior end of dampening material 711, and the inferior end of structural body 713 can be in contact with the superior end of the inside of the bottom of electronic percussion instrument 701.

Figure 8:
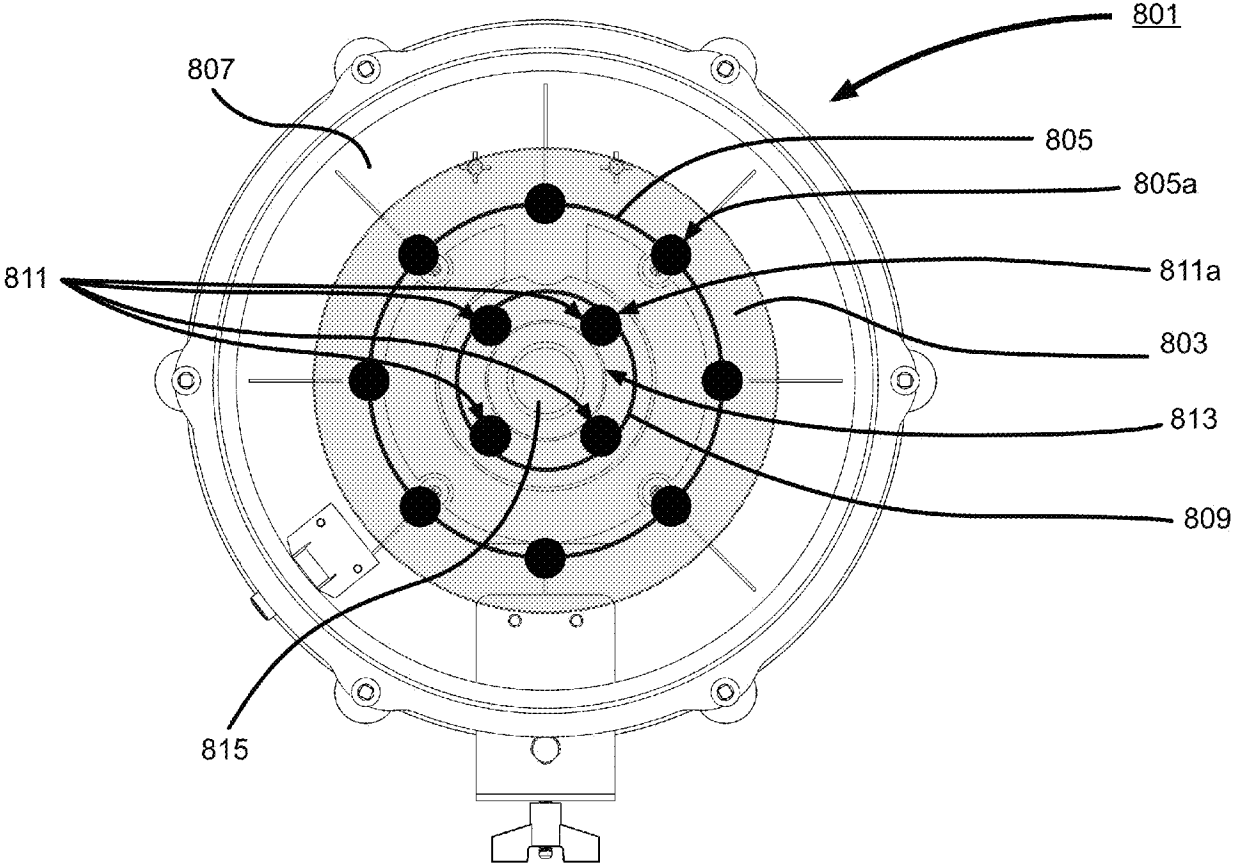
FIG. 8 is an exemplary image of an overhead view of a plate with shock absorbing posts superimposed on a sensor inside an electronic percussion instrument, consistent with some of the embodiments of the present disclosure.

FIG. 8 is an exemplary image of an overhead view of a plate with shock absorbing posts superimposed on a sensor inside an electronic percussion instrument, consistent with some embodiments of the present disclosure. FIG. 8 illustrates how the shape and size of a plate as well as the quantity of shock absorbing posts can increase the sensitivity of a sensor. The inside of electronic percussion instrument 801 may be comprised of sensor 809 and shell 807. Plate 803 can be a plate with shock absorbing posts, superimposed on sensor 809, that can have a greater area than plate 813. Plate 803 illustrates how a plate of a larger area can increase the area over which a user can strike a playing surface (not shown), such that sensor 809 generates electrical signals of equivalent magnitude (sensitivity).

Sensor 809 may comprise shock absorbing posts 811, plate 813, and electromechanical transducer 815. Plate 813 can be used to transfer vibrations, induced by a user striking a playing surface (not shown), to electromechanical transducer 815 via shock absorbing posts 811. The superior end of electromechanical transducer 815 can be in contact with the inferior end of plate 813.

Shock absorbing posts 805 may be perpendicular to the cross-sectional area of plate 803. The inferior end of shock absorbing posts 805 can be in contact with plate 803. Shock absorbing posts 805 can transmit a received impact from a playing surface (not shown) to plate 803, and plate 803 can transmit the received impact to electromechanical transducer 815.

Shell 807 may be made of the same material, have the same components (e.g., flanges 303), and same structure as shell 307.

If plate 803 is used instead of plate 813, then the area over which a user may strike a playing surface to generate electrical signals of equivalent magnitude can be increased. For instance, if shock absorbing post 805*a* is a greater radial distance from the center of electromechanical transducer 815 than shock absorbing post 811*a*, then a strike of equal force, within a concentric area of a playing surface between shock absorbing post 805*a* and 811*a* can result in electromechanical transducer 815 generating an electrical signal with a magnitude equivalent to a magnitude of an electrical signal corresponding to a strike within a concentric area of a playing surface between the center of electromechanical transducer 815 and shock absorbing post 811*a*.

Figure 9:
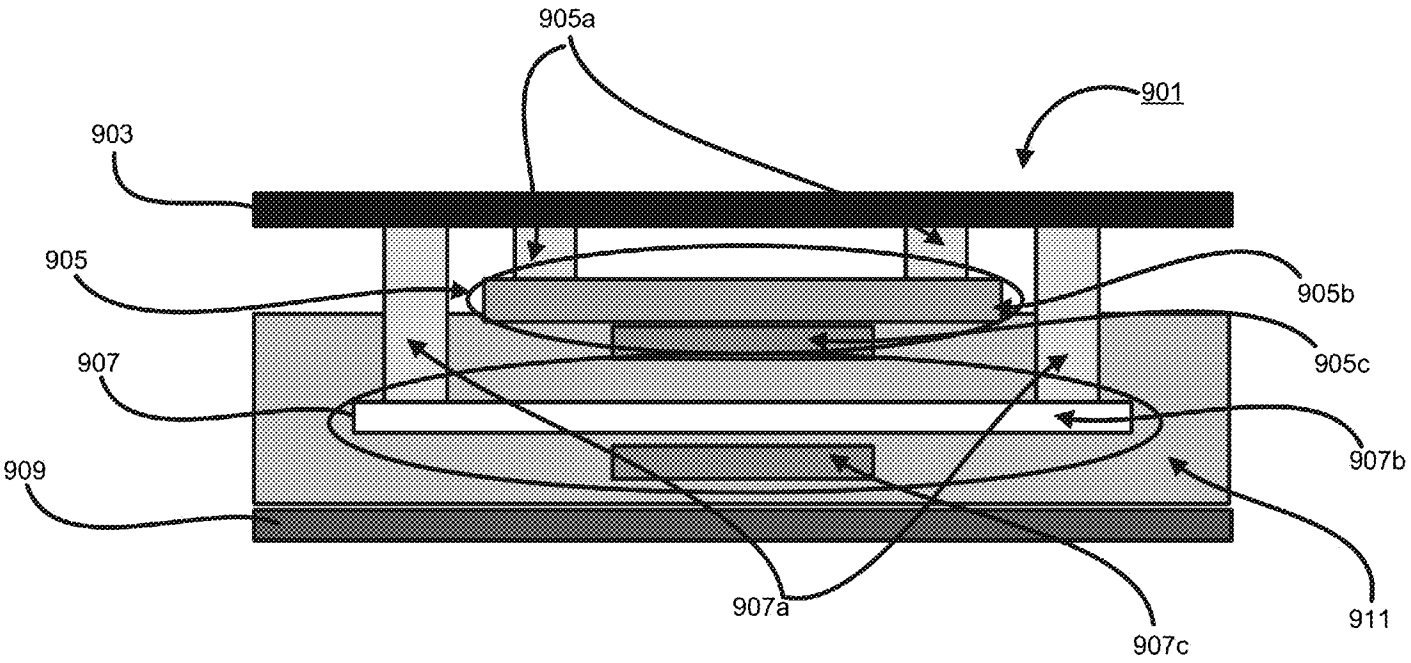
FIG. 9 is a diagram illustrating an exemplary cross-sectional view of two sensors inside an electronic percussion instrument, consistent with some of the embodiments of the present disclosure.

FIG. 9 shows a diagram illustrating an exemplary cross-sectional view of two sensors inside an electronic percussion instrument, consistent with some embodiments of the present disclosure. Electronic percussion instrument 901 may comprise playing surface 903, first sensor 905, second sensor 907, and structural body 909. First sensor 905 may comprise shock absorbing posts 905*a*, plate 905*b*, and electromechanical transducer 905*c*. Second sensor 907 may comprise shock absorbing posts 907*a*, plate 907*b*, and electromechanical 907*c*. Electronic percussion instrument 901 may further comprise dampening material 911.

Playing surface 903 may be composed of the same material as playing surface 703. Shock absorbing posts 905*a* and 907*a* may be composed of the same material as shock absorbing posts 705. The superior end of shock absorbing posts 905*a* and 907*a* may be in contact with the inferior end of playing surface 903.

Plates 905*b* and 907*b* may be composed of the same material as plate 707. The superior end of plate 905*b* and 907*b* may be in contact with the inferior end of shock absorbing posts 905*a* and 907*a*.

Electromechanical transducers 905*c* and 907*c* may be composed of the same crystalline piezoelectric material as electromechanical transducer 709. The superior end of electromechanical transducers 905*c* and 907*c* may be in contact with the inferior end of plate 905*b* and 907*b* respectively.

Dampening material 911 may be composed of the same dampening material as dampening material 711. The superior end of dampening material 911 can be in contact with the inferior end of electromechanical transducer 905*c* and can surround electromechanical transducer 907*c*.

Structural body 909 may be composed of the same material as structural body 713. The superior end of structural body 909 can be in contact with the inferior end of dampening material 911, and the inferior end of structural body 909 can be in contact with the superior end of the inside of the bottom of electronic percussion instrument 901.

First sensor 905 and second sensor 907 can perform the same function as sensor 601. That is, when a user strikes playing surface 903, first sensor 905 or second 907 can generate an electrical signal with a magnitude that may be proportional to the force exerted on playing surface 903 above shock absorbing posts 905*a* and 907*a*.

Electromechanical transducer 905*c* and 907*c* can produce electrical signals with similar magnitudes, independent of where a user strikes a playing surface. If a user strikes an area of playing surface 903 above plate 905*b* or 907*c* with equal force, the electrical signal generated by electromechanical transducer 905*c* can have a magnitude equivalent to the magnitude of an electrical signal generated by electromechanical transducer 907*c*. This can enable electronic percussion instrument 901 to generate a more consistent electrical signal regardless of where playing surface 903 is struck. Therefore the burden on the user, of pinpointing, and striking, a specific location on a playing surface in order to get electronic percussion instrument 901 to generate a certain electrical signal is lifted.

Even though electromechanical transducer 907*c* and 905*c* can produce electrical signals with equivalent magnitudes, the magnitudes may not be exactly equal. However, changing the shape, size, and orientation of the sensors can enable electronic percussion instrument 901 to produce electrical signals that have magnitudes that are exactly equal regardless of where a user strikes a playing surface. In some embodiments, a plurality of cascading sensors can be added to electronic percussion instrument 901, to create a uniform sensitivity level across the entire area of playing surface 903. Therefore, additional sensors can be added to electronic percussion instrument 901, to create additional segments of playing surface 903 that may be directly in contact with a single sensor.

Figure 10:
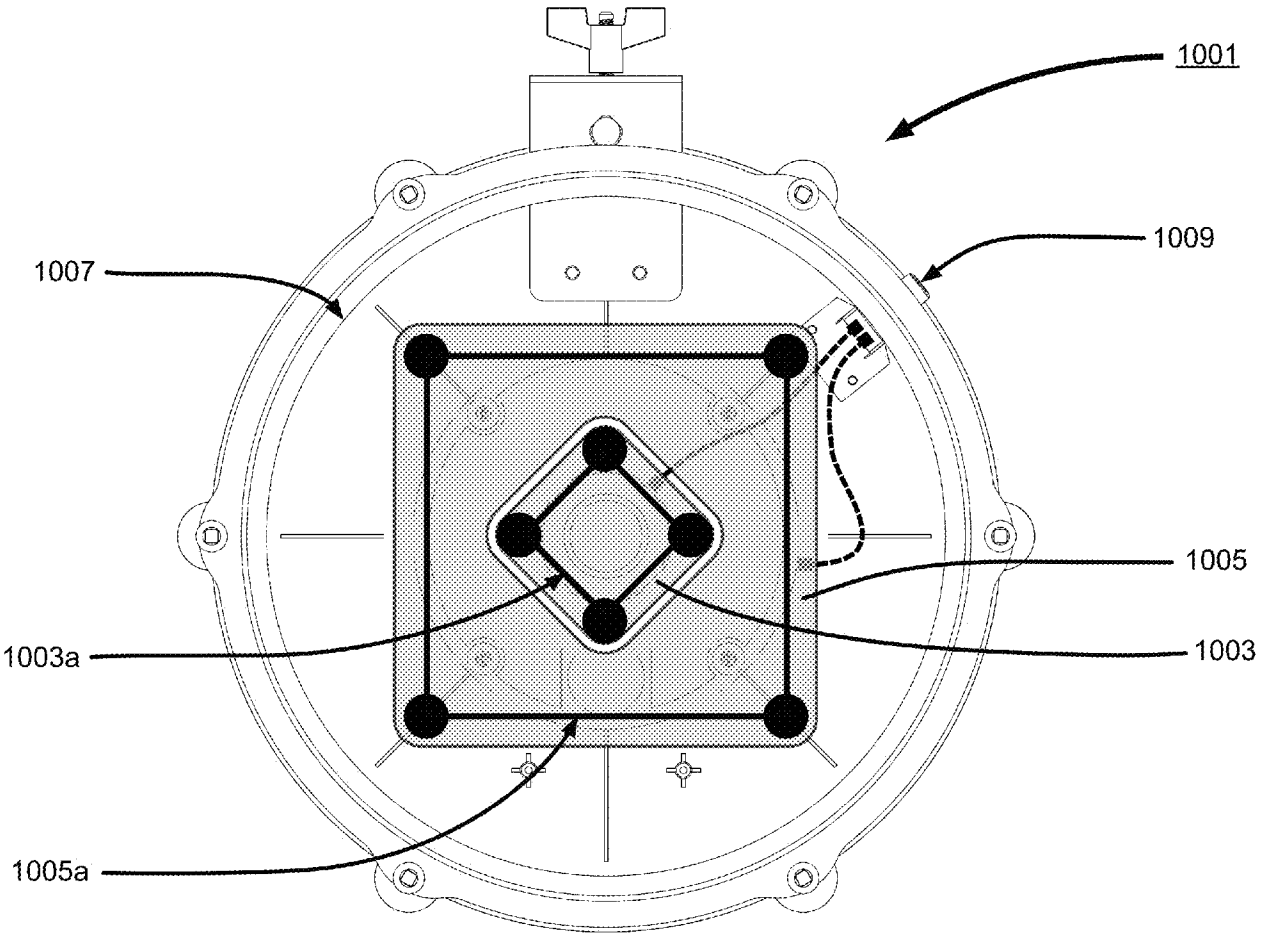
FIG. 10 is an exemplary image of an overhead view of two vertically cascaded plates affixed to two sets of shock absorbing posts, and a potentiometer inside an electronic percussion instrument, consistent with some of the embodiments of the present disclosure.

FIG. 10 is an exemplary image of an overhead view of two plates affixed to two sets of shock absorbing posts, and a potentiometer inside an electronic percussion instrument, consistent with some embodiments of the present disclosure. The inside of electronic percussion instrument 1001 may comprise plate 1003 and 1005, shock absorbing posts 1003*a* and 1005*a*, shell 1007, and potentiometer 1009. Plate 1003 and 1005 may have a square shape. In other embodiments plate 1003 and 1005 may have a circular shape, and/or other shape. Shock absorbing posts 1003*a* and 1005*a* may be perpendicular to the cross-sectional area of plate 1003 and 1005 respectively. The superior end of shock absorbing posts 1003*a* and 1005*a* may be in contact with a playing surface (not shown). The inferior end of shock absorbing posts 1003*a* may be in contact with the plate 1003, and shock absorbing posts 1005*a* may be in contact with plate 1005. If a user strikes the playing surface within an area above plate 1003, shock absorbing post 1003*a* may transmit the received impact from the playing surface to plate 1003. And plate 1003 may transmit the received impact to an electromechanical transducer (not shown) in contact with plate 1003. If a user strikes the playing surface within an area above plate 1005, shock absorbing posts 1005*a* may transmit the received impact to plate 1005. And plate 1005 may transmit the received impact to an electromechanical transducer (not shown) in contact with plate 1005. The inferior end of plate 1003 may be in contact with the superior end of an electromechanical transducer. The inferior end of plate 1005 may be in contact with the superior end of another electromechanical transducer.

The area of plate 1003 can be greater than the area of the electromechanical transducer (not shown) that is in contact with it. If the area of plate 1003 is greater than the area of the electromechanical transducer affixed to it, then the magnitude of an electrical signal produced by the electromechanical transducer can be equivalent to the magnitude of an electrical signal generated by the electromechanical transducer when a user strikes any area of the playing surface, with the same force, above plate 1003. Similarly, the area of plate 1005 can be greater than the area of the electromechanical transducer (not shown) that is in contact with it. If the area of plate 1005 is greater than the area of the electromechanical transducer affixed to it, then the magnitude of an electrical signal produced by the electromechanical transducer can be equivalent to the magnitude of an electrical signal generated by the electromechanical transducer when a user strikes any area of the playing surface, with the same force, between plate 1003 and plate 1005.

Potentiometer 1009 can be a variable resistor (e.g., rheostat) that can be used to adjust the sensitivity level of the electromechanical transducer affixed to the bottom of plate 1003 and the electromechanical transducer affixed to the bottom of plate 1005. Adjusting the variable resistor can correspond to increasing or decreasing the resistance. In some embodiments, the sensitivity level of the electromechanical transducer affixed to the bottom of plate 1003 may be greater than the sensitivity level of the electromechanical transducer affixed to the bottom of plate 1005. Therefore, an electrical signal produced by an electromechanical transducer affixed to the bottom of plate 1003 may have a greater magnitude than an electrical signal produced by an electromechanical transducer affixed to the bottom of plate 1005. In other embodiments, the sensitivity level of an electromechanical transducer affixed to the bottom of plate 1005 may be greater than the sensitivity level of an electromechanical transducer affixed to the bottom of plate 1003.

In yet other embodiments, potentiometer 1009 can be adjusted so that the sensitivity levels of an electromechanical transducer affixed to 1003 and an electromechanical transducer affixed to 1005 are the same. Thus, an electromechanical transducer affixed to plate 1003 and an electromechanical transducer affixed to plate 1005 can produce electrical signals with magnitudes that are exactly the same when a user strikes any location of the playing surface.

In some embodiments, an electronic percussion instrument may comprise sensors (plates, shock absorbing posts, and electromechanical transducer) that can be oriented in such a way that they are not cascaded vertically as illustrated in FIG. 9 and FIG. 10.

Figure 11:
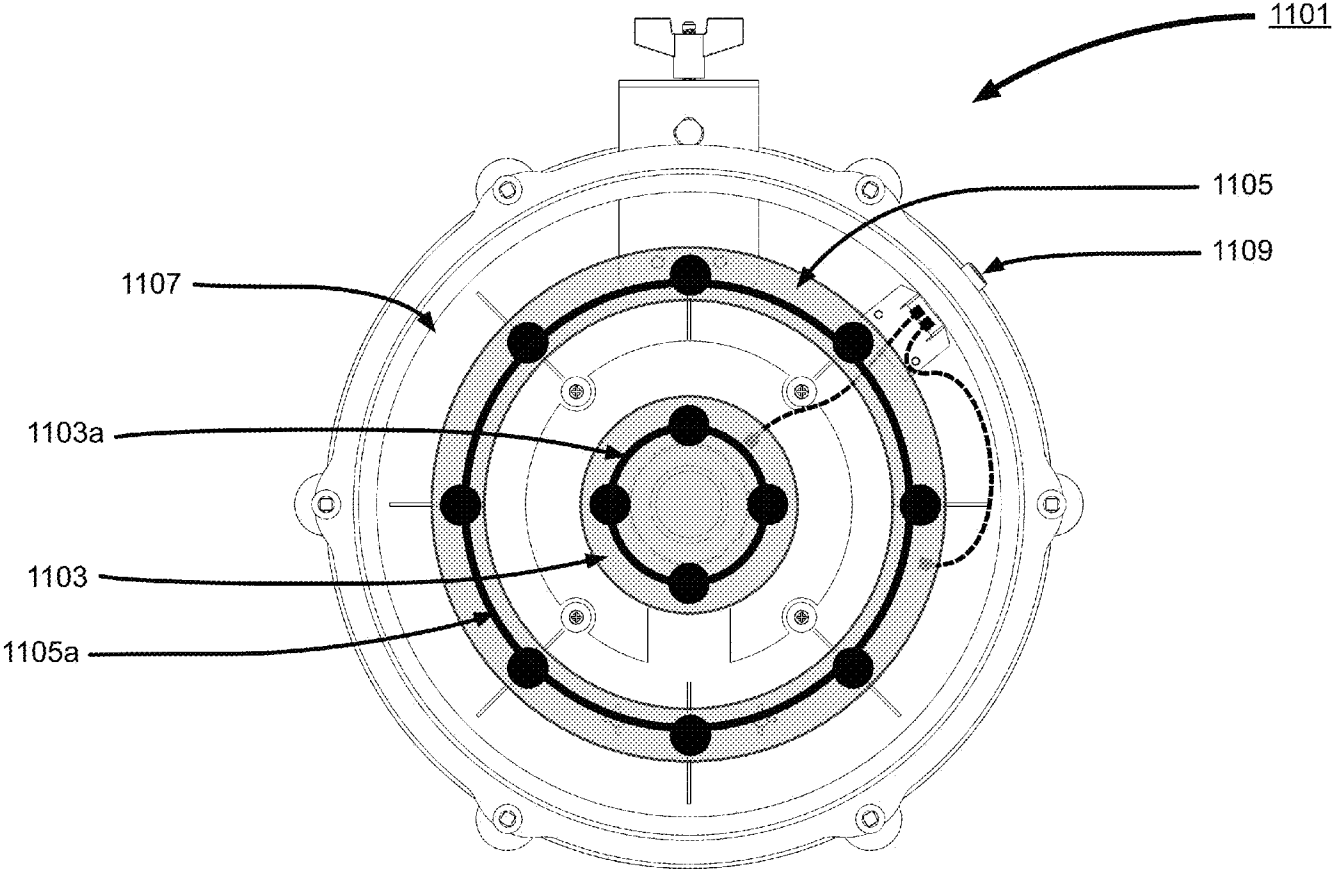
FIG. 11 is an exemplary image of an overhead view of two non-overlapping concentric plates affixed to two sets of shock absorbing posts, and a potentiometer, inside an electronic percussion instrument, consistent with some of the embodiments of the present disclosure.

FIG. 11 is an exemplary image of an overhead view of two non-overlapping concentric plates affixed to two sets of shock absorbing posts, and a potentiometer, inside an electronic percussion instrument, consistent with some embodiments of the present disclosure.

The electronic percussion instrument 1101 may comprise plate 1103 and 1105, shock absorbing posts 1103*a* and 1105*a*, shell 1107, and potentiometer 1109. Plate 1103 and 1105 may have a ring shape. In other embodiments plate 1103 and 1105 may have other shapes. Shock absorbing posts 1103*a* and 1105*a* may be perpendicular to the cross-sectional area of plate 1103 and 1105 respectively. The superior end of shock absorbing posts 1103*a* and 1105*a* may be in contact with a playing surface (not shown). The inferior end of shock absorbing posts 1103*a* can be in contact with the plate 1103, and shock absorbing posts 1105*a* can be in contact with plate 1105. If a user strikes a playing surface within an area above plate 1103, shock absorbing posts 1103*a* may transmit the received impact from a playing surface to plate 1103. And plate 1103 may transmit a received impact to an electromechanical transducer (not shown) in contact with plate 1103. If a user strikes a playing surface within an area above plate 1105, shock absorbing posts 1105*a* may transmit a received impact to a playing surface to plate 1105. And plate 1105 can transmit a received impact to an electromechanical transducer (not shown) in contact with plate 1105. The inferior end of plate 1103 can be in contact with the superior end of a ring shaped electromechanical transducer that is equal in circumference to the electromechanical transducer. If a user strikes a playing surface (not shown) above plate 1103, the impact can be transferred to an electromechanical transducer (not shown) that can create an electrical signal. The inferior end of plate 1105 can be in contact with the superior end of another circular electromechanical transducer. If a user strikes a playing surface above plate 1105, the impact can be transferred to an electromechanical transducer that can create an electrical signal.

Potentiometer 1109 can be the same as potentiometer 1009.

In some embodiments, sensors can be added and/or removed without having to disturb other sensors in the electronic percussion instrument. If sensors are cascaded vertically, replacing or removing a sensor that is not on top, requires removing each sensor between the sensor that needs to be replaced and the sensor on top. Adding additional concentric sensors can increase the sensitivity of an electronic percussion instrument.

This is because each concentric sensor can comprise a greater number of shock absorbing posts whose superior ends are in direct contact with the inferior end of a playing surface. Increasing the number of concentric sensors increases the number of shock absorbing posts that are in contact with the playing surface, resulting in an increased ability of each electromechanical transducer associated with a corresponding concentric sensor to generate electrical signals with the same magnitudes when a user strikes any location of the playing surface. Each electromechanical transducer can have a superior end that can be in contact with the entire circumference of the inferior end of a concentric sensor plate that has shock absorbing posts along the entire circumference of its superior end. Therefore, when a user strikes any area of a playing surface, with the same force, the magnitude of an electrical signal generated by each electromechanical transducer can be exactly the same. Therefore in some embodiments it is possible for an electronic percussion instrument to create the exact same electrical signal regardless of where a user strikes the playing surface, if a plurality of concentric sensors is used.

Figure 12:
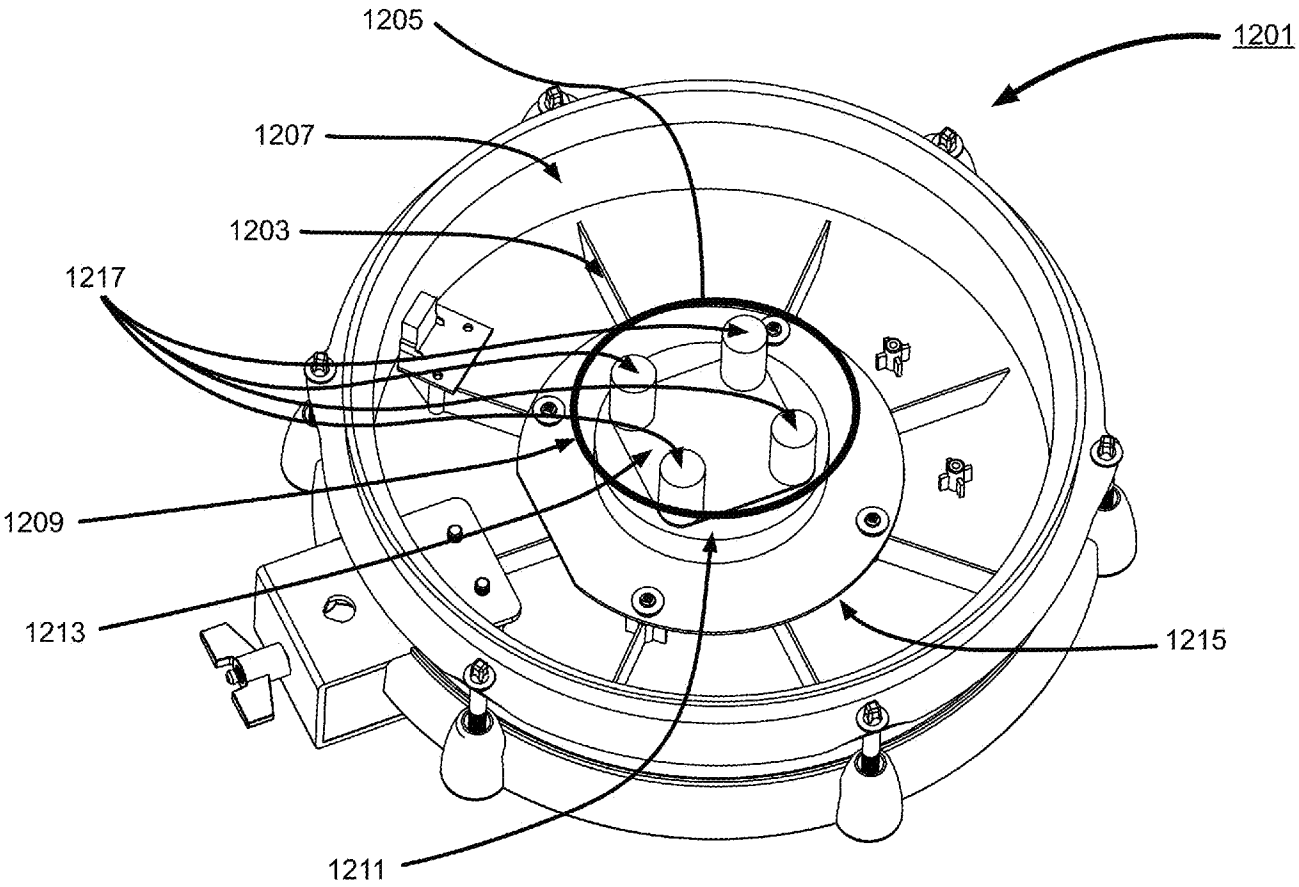
FIG. 12 is an exemplary image of the inside of an electronic percussion instrument, consistent with some of the embodiments of the present disclosure.

FIG. 12 is an exemplary image of the inside of an electronic percussion instrument, consistent with some embodiments of the present disclosure. Electronic percussion instrument 1201 may comprise one or more flanges 1203 extending from sensor enclosure 1205 to the perimeter of the interior of shell 1207. In some embodiments the orientation and quantity of flanges 1203 can modify the acoustic waves generated by a user striking a playing surface (not shown). Flanges 1203 can be used to strengthen electronic percussion instrument 301, and to absorb sound waves, thereby minimizing echoes produced by the inside of electronic percussion instrument 1201, when a user strikes a playing surface (not shown). In some embodiments flanges 1203 can be used to create an anechoic chamber (i.e., echo-free chamber) within electronic percussion instrument 1201. Therefore the quantity and orientation of flanges 1203 can create an echo-free chamber thereby enabling electronic percussion instrument 1201 to produce no sound (i.e., no acoustic sound) within the interior of shell 1207. This would enable a user to play electronic percussion instrument 1201 silently. In other embodiments, electronic percussion instrument 1201 might produce a sound when a user strikes a playing surface.

Sensor enclosure 1205 may comprise sensor 1209, dampening material 1211, and plate 1213. Sensor 1209, dampening material 1211, and plate 1213 can be composed of the same materials as sensor 601, dampening material 711, and plate 707 respectively. Sensor 1209, dampening material 1211, and plate 1213 can have the same orientation within sensor enclosure 1205 as sensor 309, dampening material 311, and plate 313 within sensor enclosure 305.

Sensor 1209 can have a quadrilateral shape. In some embodiments sensor 1209 can have a triangular, circular, or ring shape.

Figure 13:
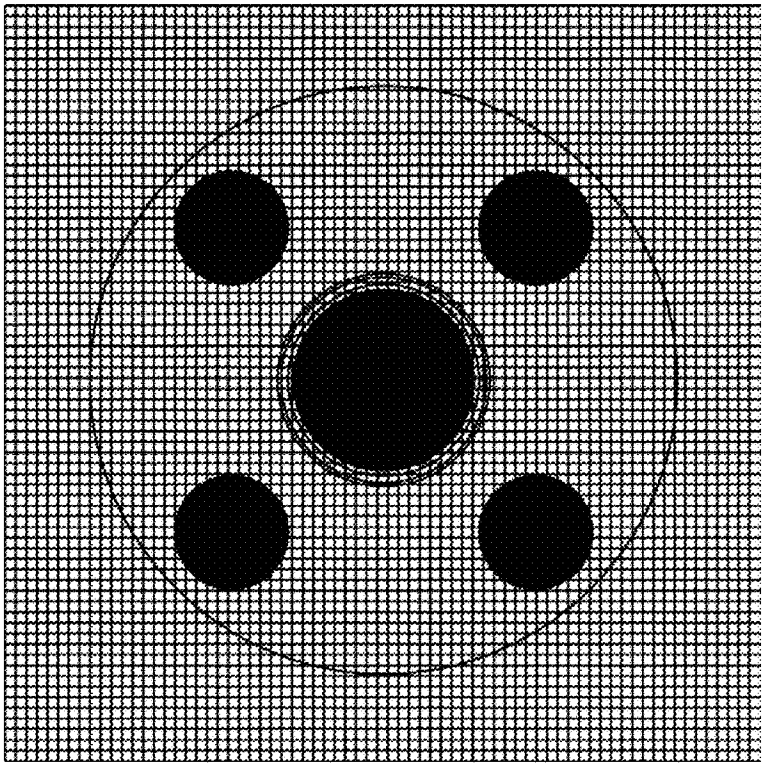
FIG. 13 is an exemplary image of the superior end of a sensor in contact with the inferior end of a playing surface on an electronic percussion instrument, consistent with some of the embodiments of the present disclosure.

FIG. 13 is an exemplary image of the superior end of a sensor in contact with the inferior end of a playing surface on an electronic percussion instrument, consistent with some embodiments of the present disclosure. In some embodiments, the inferior end of a playing surface of an electronic percussion instrument can be made of a mesh material that can be in touch with the superior end of one or more shock absorbing posts.

Figure 14:
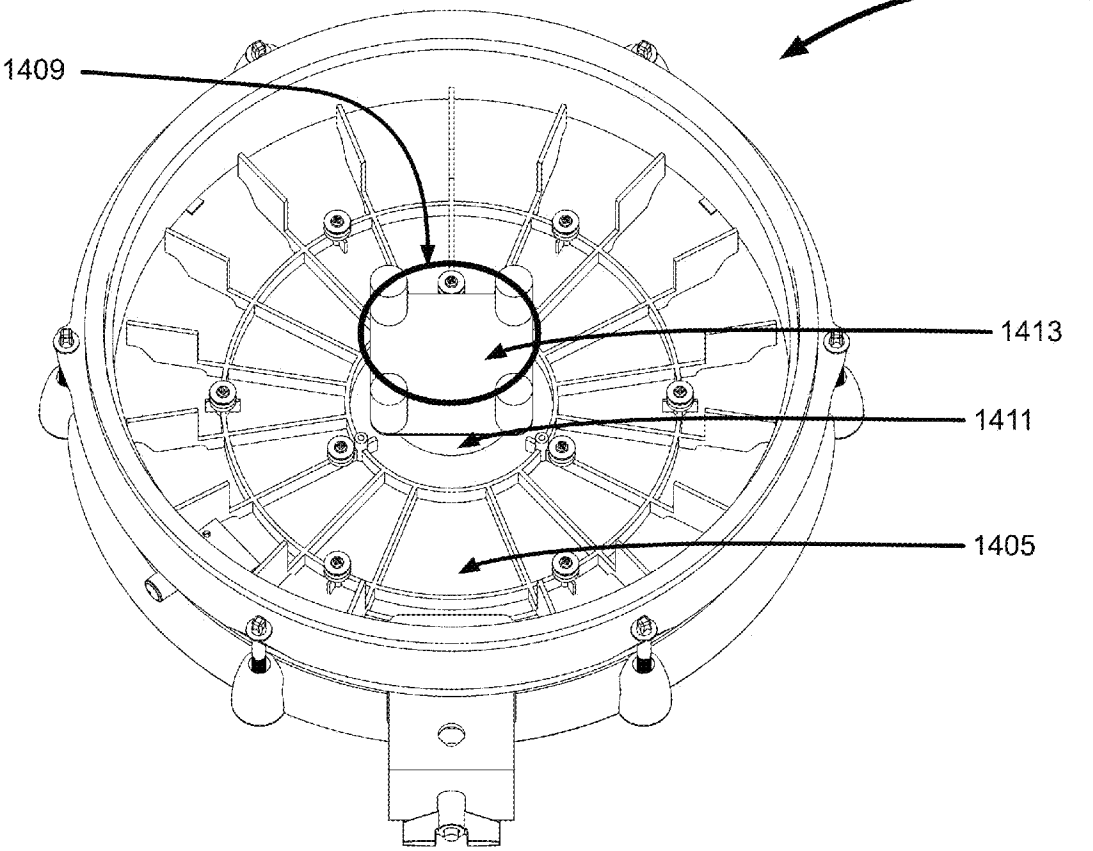
FIG. 14 is an exemplary image of an overhead view of the inside of an electronic percussion instrument, consistent with some of the embodiments of the present disclosure.

FIG. 14 is an exemplary image of an overhead view of the inside of an electronic percussion instrument, consistent with some embodiments of the present disclosure. Electronic percussion instrument 1401 can be comprised of the same components and materials as electronic percussion instrument 301.

Sensor enclosure 1405 can comprise sensor 1409, dampening material 1411, and plate 1413. Sensor 1409, dampening material 1411, and plate 1413 can be composed of the same materials as sensor 601, dampening material 711, and plate 707 respectively. Sensor 1409, dampening material 1411, and plate 1413 can be arranged the same way sensor 309, dampening material 311, and plate 313 are arranged within sensor enclosure 305.

Figure 15:
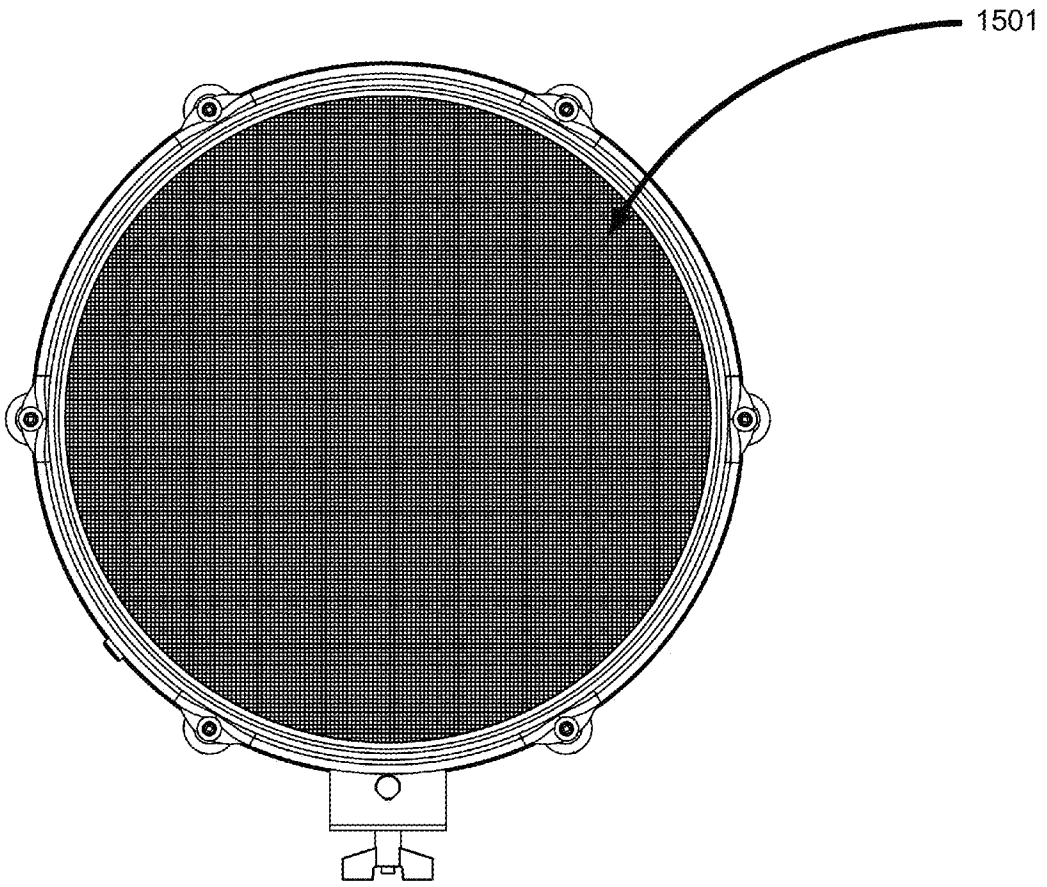
FIG. 15 is an exemplary image of an overhead view of a playing surface on an electronic percussion instrument, consistent with some of the embodiments of the present disclosure.

FIG. 15 is an exemplary image of an overhead view of a playing surface on an electronic percussion instrument, consistent with some embodiments of the present disclosure. The inferior end of playing surface 1501 may be in contact with the superior end of an insulation material. When a user strikes playing surface 1501 the striking object generates vibrations in playing surface 1501, which are transferred to an insulation material in contact with the inferior end of playing surface 1501.

Figure 16:
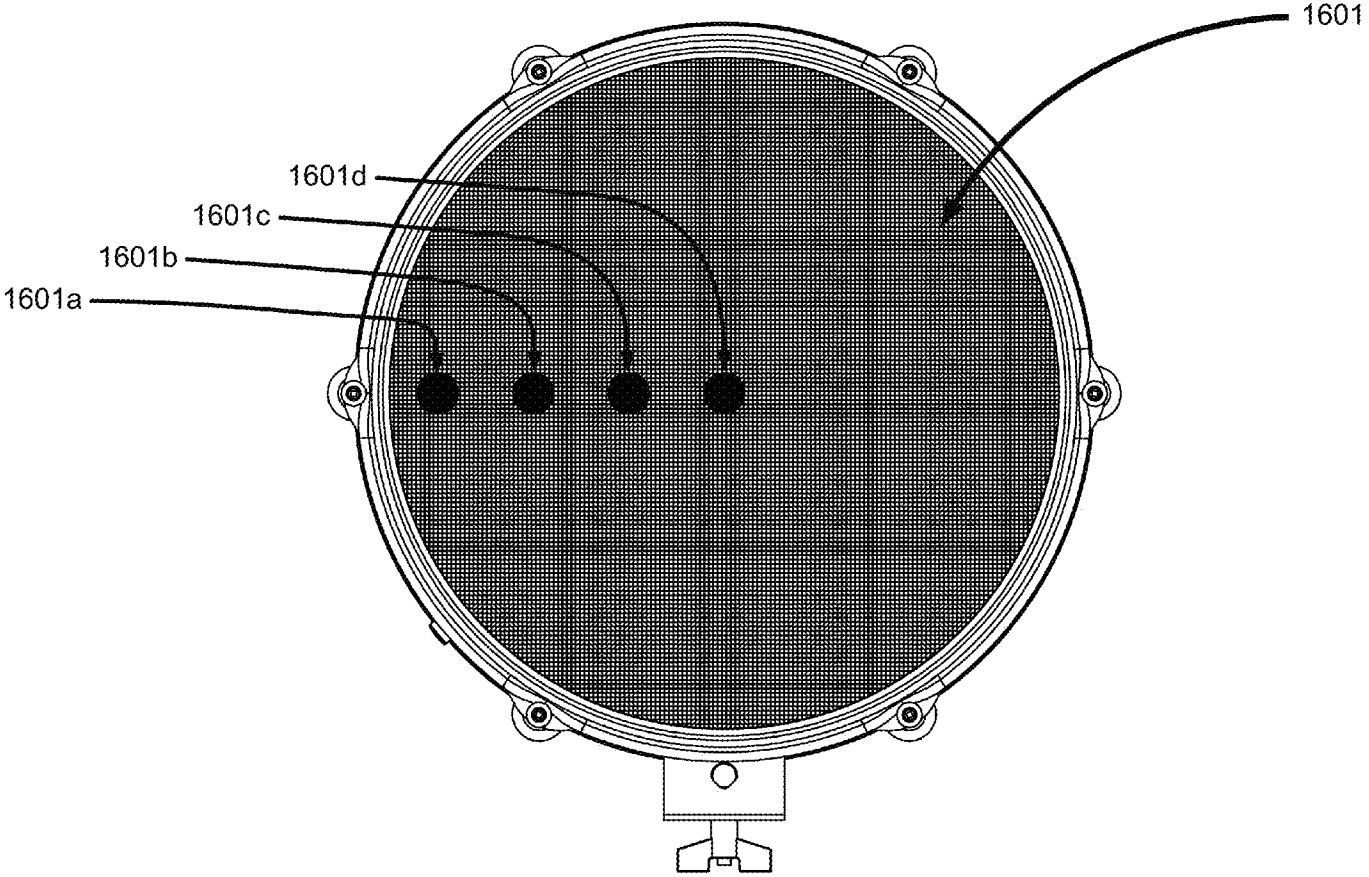
FIG. 16 is an exemplary image of an overhead view of impact locations on a playing surface of an electronic percussion instrument, consistent with some of the embodiments of the present disclosure.

FIG. 16 is an exemplary image of an overhead view of impact locations on a playing surface of an electronic percussion instrument, consistent with some embodiments of the present disclosure. Playing surface 1601 can have four impact locations (outer impact location 1601*a*, middle impact location 1601*b*, middle impact location 1601*c*, and center impact location 1601*d*). Each impact location represents different radii that correspond to different sensitivity levels across playing surface 1601.

The sensitivity may be determined by measuring the velocity with which a user strikes playing surface 1601. Drum module 105 may measure the velocity with which a user strikes playing surface 1601 by measuring oscillatory features of an electrical signal generated by an electromechanical transducer when a user strikes playing surface 1601. Areas of playing surface 1601 that can induce an electromechanical transducer to generate electrical signals with higher velocities can have higher sensitivities.

In some embodiments, playing surface 1601 may be composed of a Mylar material and outer impact location 1601*a* can have a MIDI velocity range of 17-20, middle impact location 1601*b* can have a MIDI velocity range of 46-52, middle impact location 1601*c* can have a MIDI velocity range of 46-57, and center impact location 1601*d* can have a MIDI velocity range of 50-60.

In other embodiments, playing surface 1601 may be composed of a Mesh material. If playing surface 1601 is composed of a mesh material, outer impact location 1601*a* can have a MIDI velocity range of 17-22, middle impact location 1601*b* can have a MIDI velocity range of 17-29, middle impact location 1601*c* can have a MIDI velocity range of 36-46, and center impact location 1601*d* can have a MIDI velocity range of 50-60.

Figure 17:
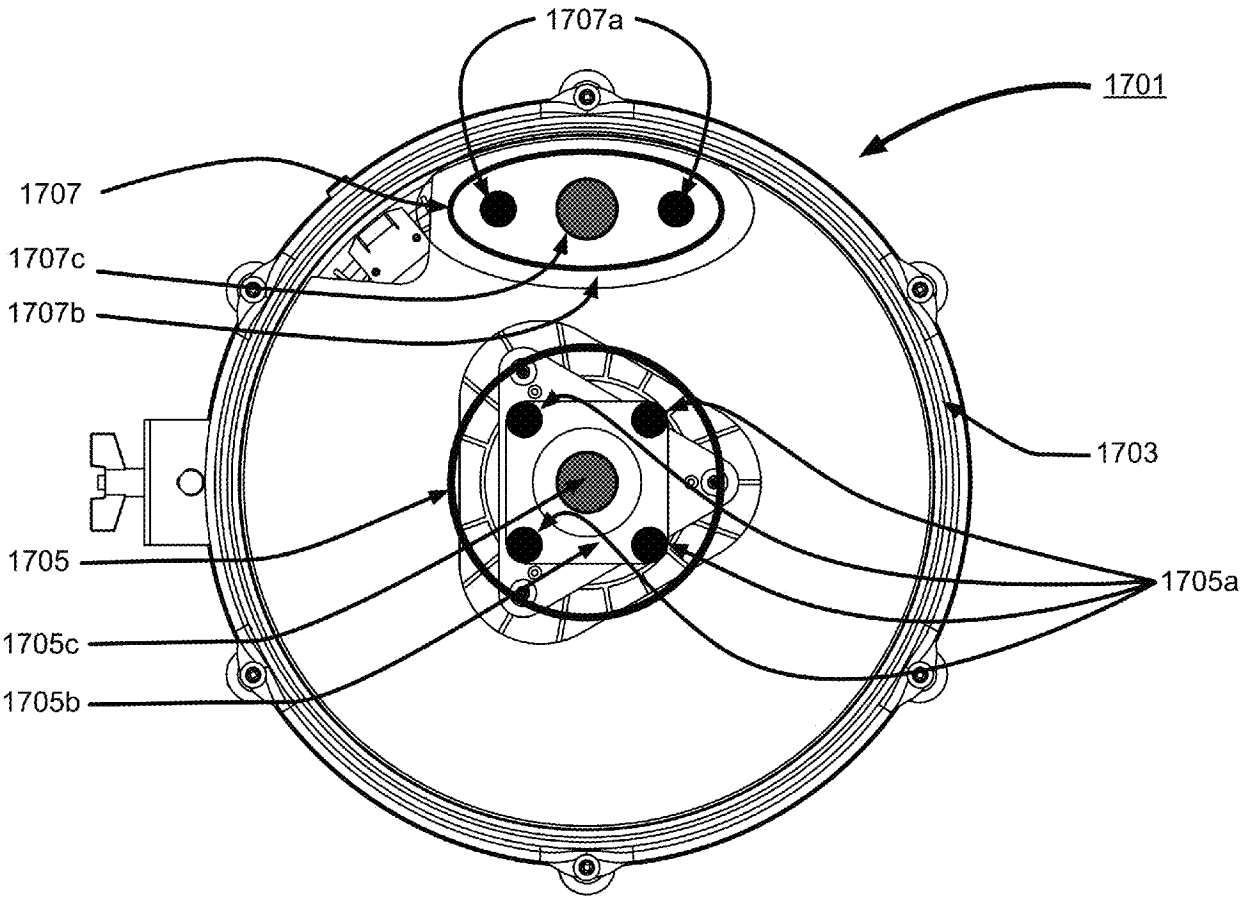
FIG. 17 is an exemplary image of an overhead view of an inner and outer sensor inside an electronic percussion instrument, consistent with some of the embodiments of the present disclosure.

FIG. 17 is an exemplary image of an overhead view of an inner and outer sensor inside an electronic percussion instrument, consistent with some embodiments of the present disclosure.

Electronic percussion instrument 1701 may comprise shell 1703, first sensor 1705, and second sensor 1707. First sensor 1705 may comprise shock absorbing posts 1705*a*, plate 1705*b*, and electromechanical transducer 1705*c*. Second sensor 1707 may comprise shock absorbing posts 1707*a*, plate 1707*b*, and electromechanical transducer 1707*c*.

Shock absorbing posts 1705*a* and 1707*a* may be composed of the same material that shock absorbing posts 705 are composed of. The superior end of shock absorbing posts 1705*a* and 1707*a* may be in contact with the inferior end of a playing surface (not shown).

The superior end of plate 1705*b* and 1707*b* may be in contact with the inferior end of shock absorbing posts 1705*a* and 1707*a*.

The superior end of electromechanical transducer 1705*c* and 1707*c* may be in contact with the inferior end of plate 1705*b* and 1707*b* respectively.

First sensor 1705 and second sensor 1707 may perform the same function as sensor 601. That is, when a user strikes a playing surface (not shown) that can be in contact with first sensor 1705 and second sensor 1707, first sensor 1705 and/or second 1707 can generate an electrical signal with a magnitude that can be proportional to the force exerted on the playing surface above shock absorbing posts 1705*a* and/or 1707*a*.

In some embodiments, plate 1705*b* can be larger and more shock absorbing posts can be used. Plate 1707*b* can be semicircular in some embodiments, and it can be a complete circle in other embodiments.

In some embodiments a potentiometer can be included to adjust the sensitivity between electromechanical transducer 1705*c* and 1707*c*.

Electromechanical transducers 1705*c* and 1707*c* can have the same or different dimensions. For instance, in some embodiments the shape and orientation of sensors can determine the dimension of each sensor. For example, if sensors 1705 and 1707 are arranged concentrically and sensor 1705 is the inner sensor and sensor 1707 is the outer sensor, then the number of shock absorbing posts 1707*a* on plate 1707*b* and the circumference of electromechanical transducer 1707*c* can be greater than the number of shock absorbing posts 1705*a* on plate 1705*b* and the circumference of electromechanical transducer 1705*c*, respectively. Therefore, because sensor 1707 can have a greater circumference than sensor 1705, sensor 1707 can have different dimensions than sensor 1705.

Figure 18:
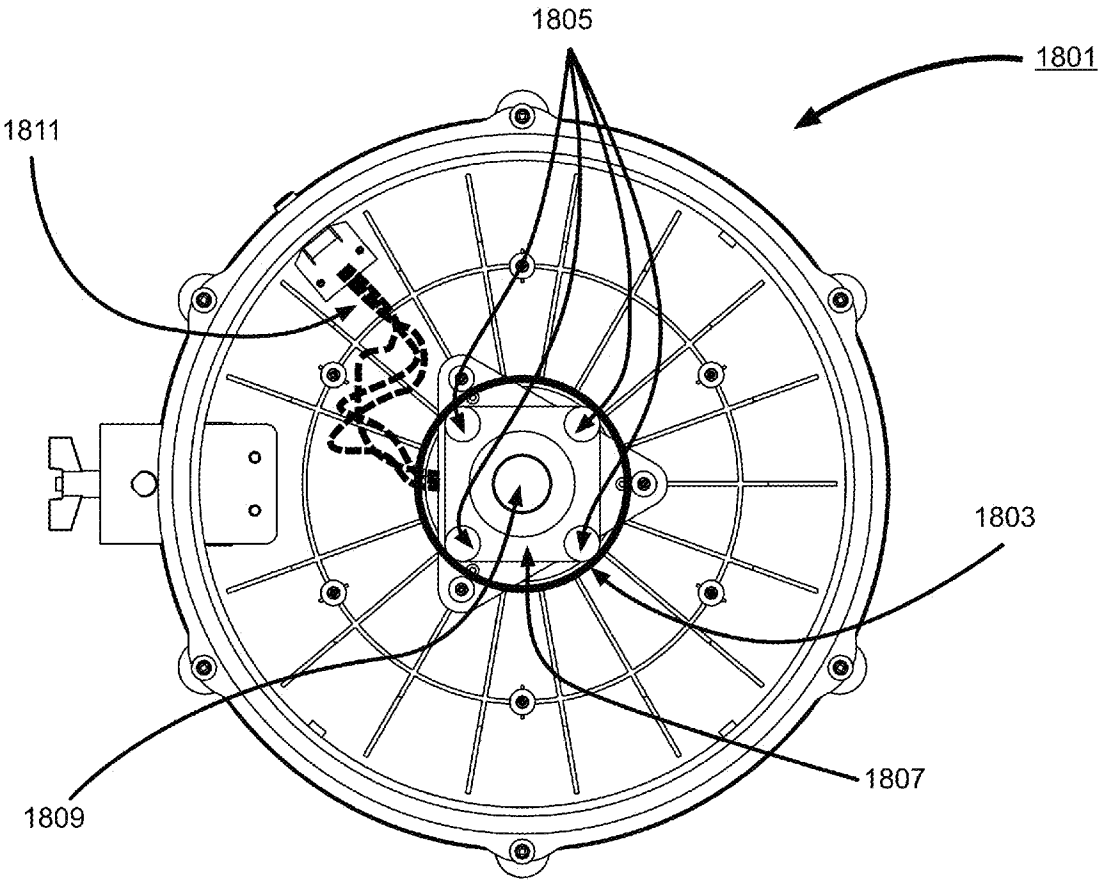
FIG. 18 is an exemplary image of an overhead view of electrical wires connected to a sensor inside an electronic percussion instrument, consistent with some of the embodiments of the present disclosure.

FIG. 18 is an exemplary image of an overhead view of electrical wires connected to a sensor inside an electronic percussion instrument, consistent with some embodiments of the present disclosure.

Electronic percussion instrument 1801 can comprise sensor 1803 and wires 1811. Sensor 1803 can comprise shock absorbing posts 1805, plate 1807, and electromechanical transducer 1809. Wires 1811 can be electrical wires attached to sensor 1803 for transmitting electrical signals to drum module 105, in response to vibrations induced in sensor 1803 by a user striking a playing surface (not shown).

Figure 19:
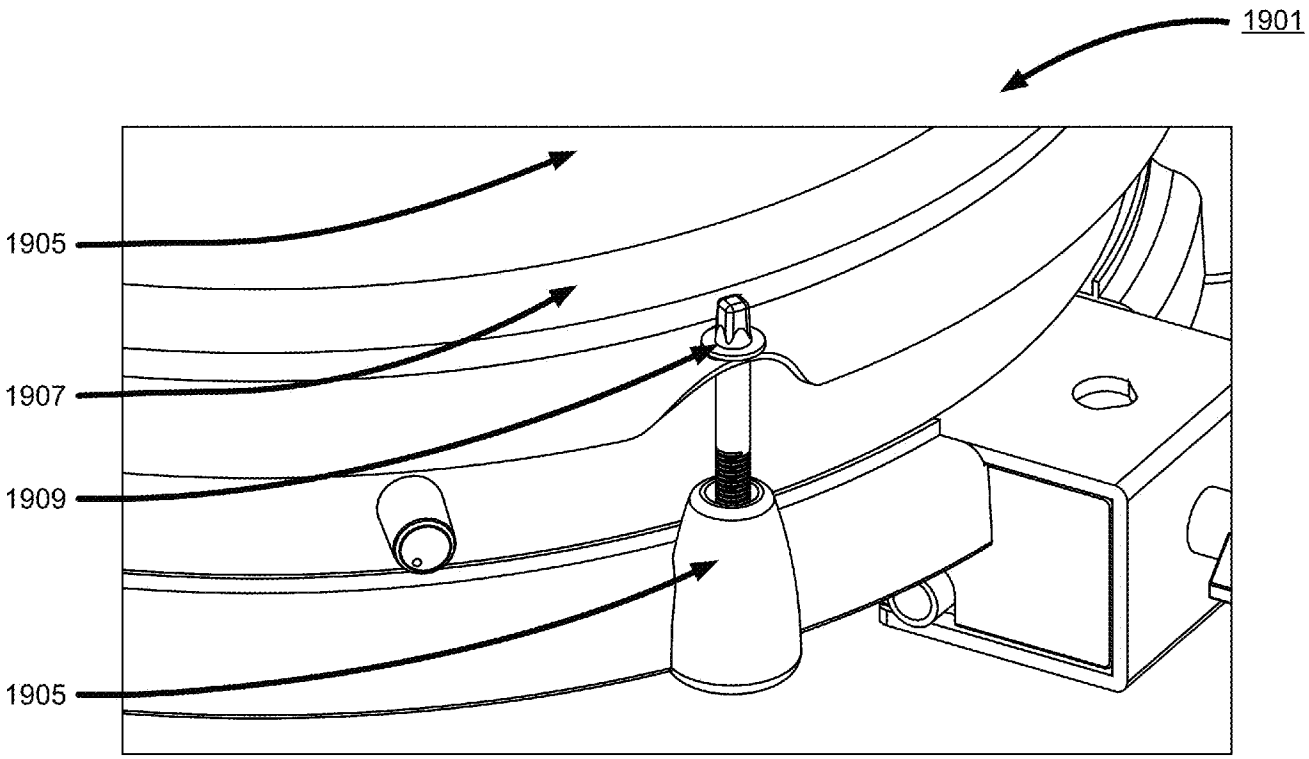
FIG. 19 is an exemplary image of the outside of an electronic percussion instrument, consistent with some of the embodiments of the present disclosure.

FIG. 19 is an exemplary image of the outside of an electronic percussion instrument, consistent with some embodiments of the present disclosure.

Electronic percussion instrument 1901 may comprise playing surface 1903, tuning rod 1905, rim 1907, and nut boxes 1909. Nut boxes 1909 may have a tapped hole with a threaded groove configured to receive tuning rods 1905 that can be screwed into nut boxes 1909. Tuning rods 1905 may be screwed into nut boxes 1909 to secure playing surface 1903 to rim 1907.

Figure 20:
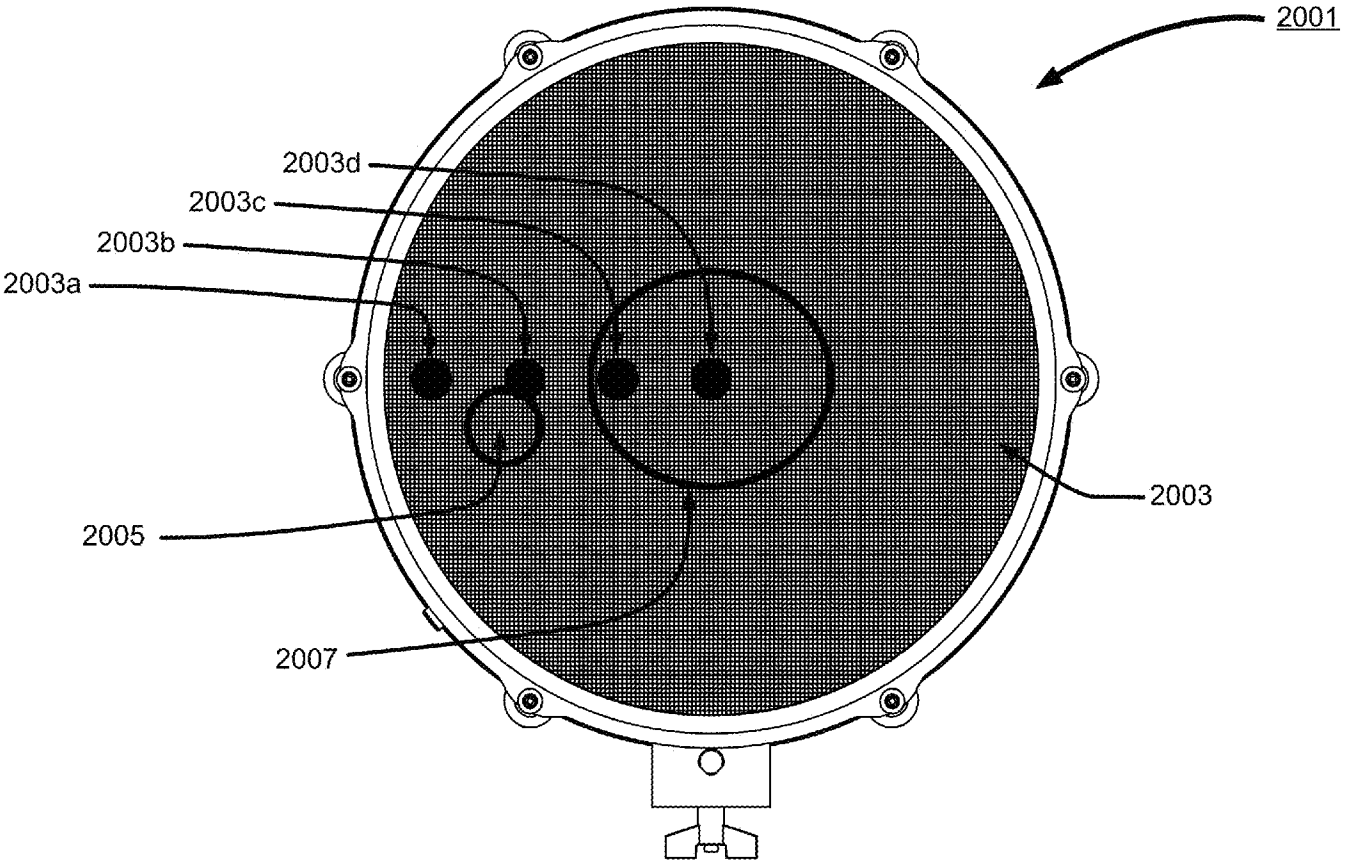
FIG. 20 is an exemplary image of an overhead view of impact locations on a playing surface of an electronic percussion instrument, consistent with some of the embodiments of the present disclosure.

FIG. 20 is an exemplary image of an overhead view of impact locations on a playing surface of an electronic percussion instrument, consistent with some embodiments of the present disclosure. Playing surface 2003 can have four impact locations (outer impact location 2003*a*, middle impact location 2003*b*, middle impact location 2003*c*, and center impact location 2003*d*). Each impact location represents different radii that correspond to different sensitivity levels across playing surface 2003.

The sensitivity can be determined by measuring the velocity with which a user strikes playing surface 2003. Drum module 105 can measure the velocity with which a user strikes playing surface 2003 by measuring oscillatory features of an electrical signal generated by an electromechanical transducer when a user strikes playing surface 2003. Areas of playing surface 2003 that can induce an electromechanical transducer to generate electrical signals with higher velocities can have higher sensitivities.

Electronic percussion instrument 2001 may comprise playing surface 2003, sensor 2005, and sensor 2007. Sensitivity levels associated with sensors 2005 and 2007 may be adjusted, with a potentiometer, so that areas on playing surface 2003 above sensor 2005 can be more/less sensitive than areas on playing surface 2003 above sensor 2007. In some embodiments sensitivity levels can be exactly the same.

In some embodiments, outer impact location 2003*a* and middle impact location 2003*b* of playing surface 2003 can be located above sensor 2005, and middle impact location 2003*c* and center impact location 2003*d* can be located above sensor 2007.

In some embodiments sensor 2007 can be adjusted to a higher sensitivity level than sensor 2005, and outer impact location 2003*a* can have a MIDI velocity range of 16-22, middle impact location 2003*b* can have a MIDI velocity range of 28-32, middle impact location 2003*c* can have a MIDI velocity range of 34-42, and center impact location 2003*d* can have a MIDI velocity range of 40-48.

In other embodiments, sensor 2007 can be adjusted to a lower sensitivity level than sensor 2005, and outer impact location 2003*a* can have a MIDI velocity range of 42-50, middle impact location 2003*b* can have a MIDI velocity range of 36-42, middle impact location 2003*c* can have a MIDI velocity range of 28-32, and center impact location 2003*d* can have a MIDI velocity range of 16-22.

In other embodiments, sensor 2007 can be adjusted to a sensitivity level that is equal to the sensitivity level of sensor 2005, and outer impact location 2003*a* can have a MIDI velocity range of 36-40, middle impact location 2003*b* can have a MIDI velocity range of 36-40, middle impact location 2003*c* can have a MIDI velocity range of 36-40, and center impact location 2003*d* can have a MIDI velocity range of 36-40.

Figure 21:
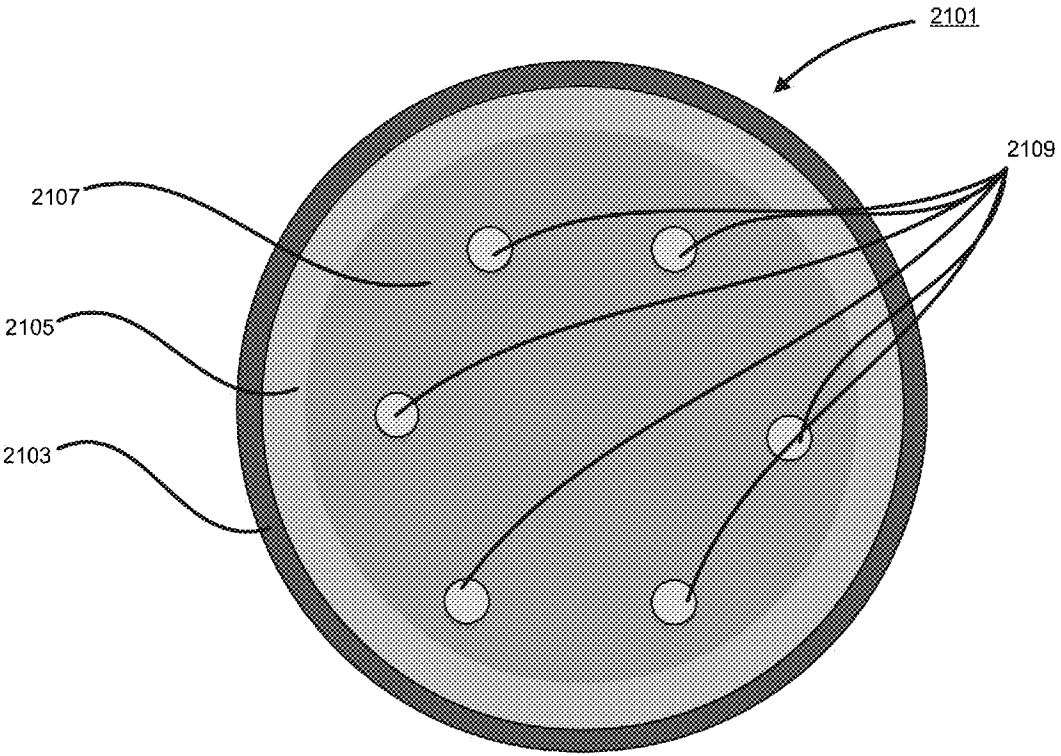
FIG. 21 shows a circular diagram illustrating an overhead view of a sensor inside an electronic percussion instrument, consistent with some of the embodiments of the present disclosure.

FIG. 21 is a circular diagram illustrating an overhead view of a sensor inside an electronic percussion instrument, consistent with some embodiments of the present disclosure. Electronic percussion instrument 2101 may comprise structural body 2103, dampening material 2105, plate 2107, and shock absorbing posts 2109.

In some embodiments structural body 2103, dampening material 2105, plate 2107, and shock absorbing posts 2109 can be composed of the same material as structural body 713, dampening material 711, plate 707, and shock absorbing posts 705. In some embodiments structural body 2103, dampening material 2105, plate 2107, and shock absorbing posts 2109 can be arranged the same way that structural body 713, dampening material 711, plate 707, and shock absorbing posts 705 can be arranged in electronic percussion instrument 701.

Figure 22:
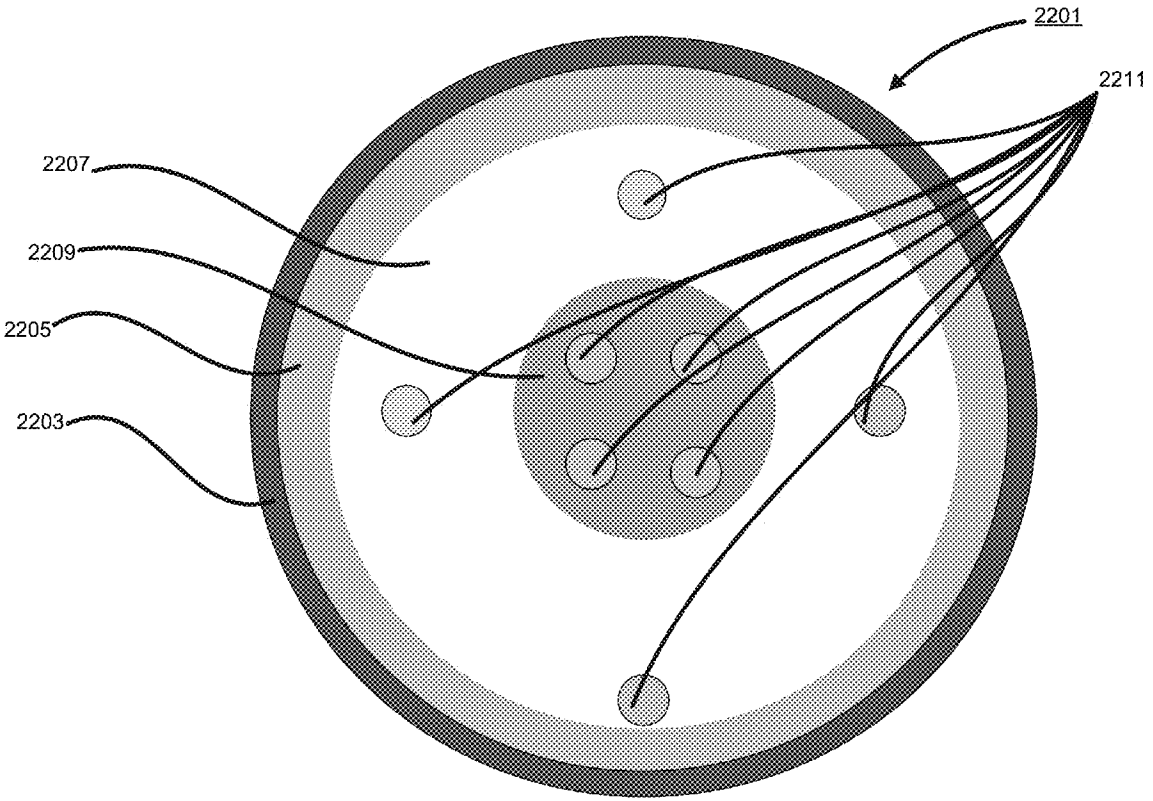
FIG. 22 shows a circular diagram illustrating an overhead view of two sensors inside an electronic percussion instrument, consistent with some of the embodiments of the present disclosure.

FIG. 22 shows a circular diagram illustrating an overhead view of two sensors inside an electronic percussion instrument, consistent with some embodiments of the present disclosure.

Electronic percussion instrument 2201 may comprise structural body 2203, dampening material 2205, plate 2207, plate 2209, and shock absorbing posts 2211.

Structural body 2203 can enclose dampening material 2205.

Dampening material 2205 can enclose plate 2207.

Figure 23:
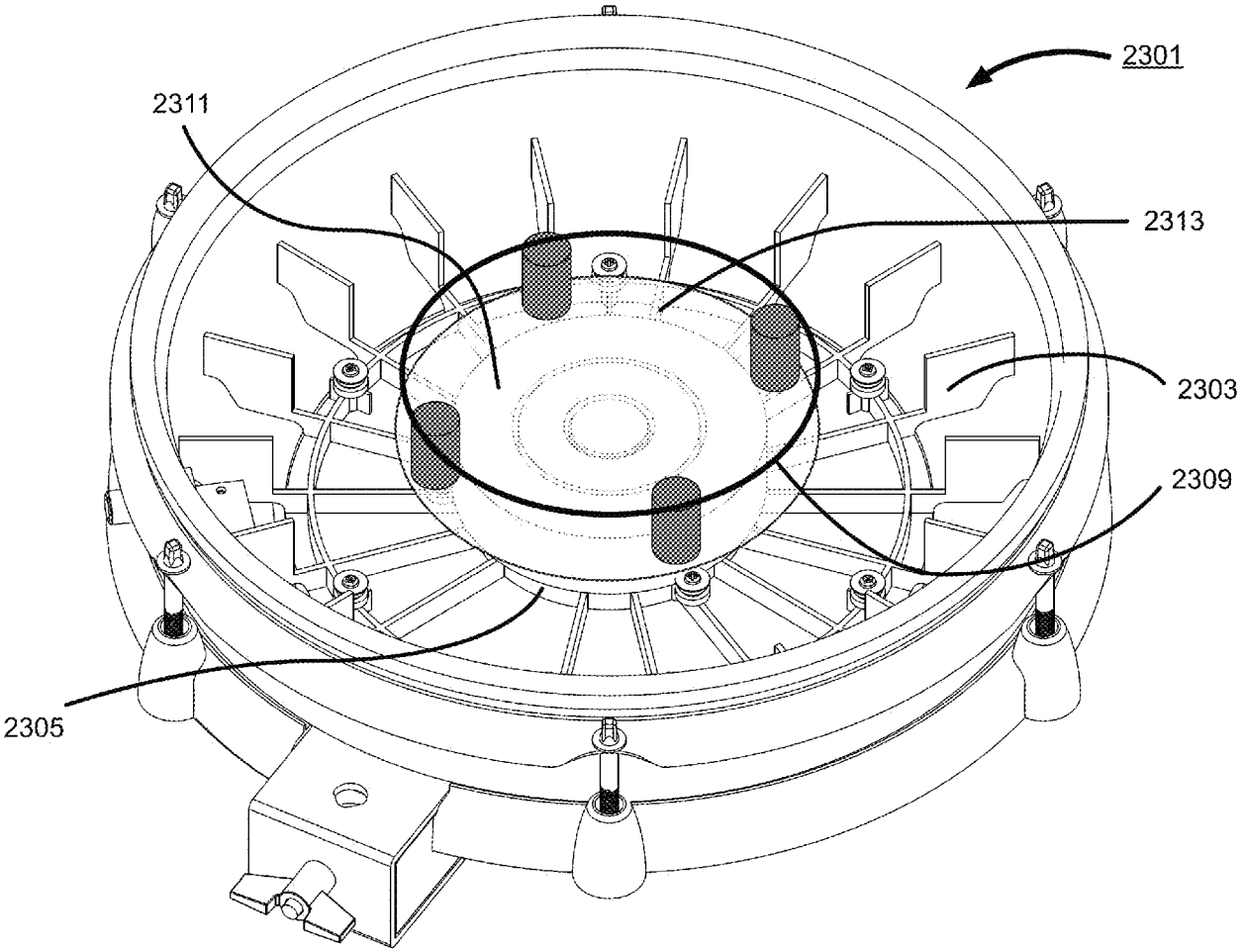
FIG. 23 is an exemplary image of a sensor inside an electronic percussion instrument, consistent with some of the embodiments of the present disclosure.

FIG. 23 is an exemplary image of a sensor inside an electronic percussion instrument, consistent with some embodiments of the present disclosure.

Sensor enclosure 2305 can comprise sensor 2309, dampening material 2311, and plate 2313. Sensor 2309, dampening material 2311, and plate 2313 can be composed of the same materials as sensor 601, dampening material 711, and plate 707 respectively. Sensor 2309, dampening material 2311, and plate 2313 can be arranged the same way sensor 309, dampening material 311, and plate 313 can be arranged within sensor enclosure 305.

Sensor 2309 can have a circular shape. In some embodiments sensor 2309 can have a triangular, quadrilateral, or ring shape.

Figure 24:
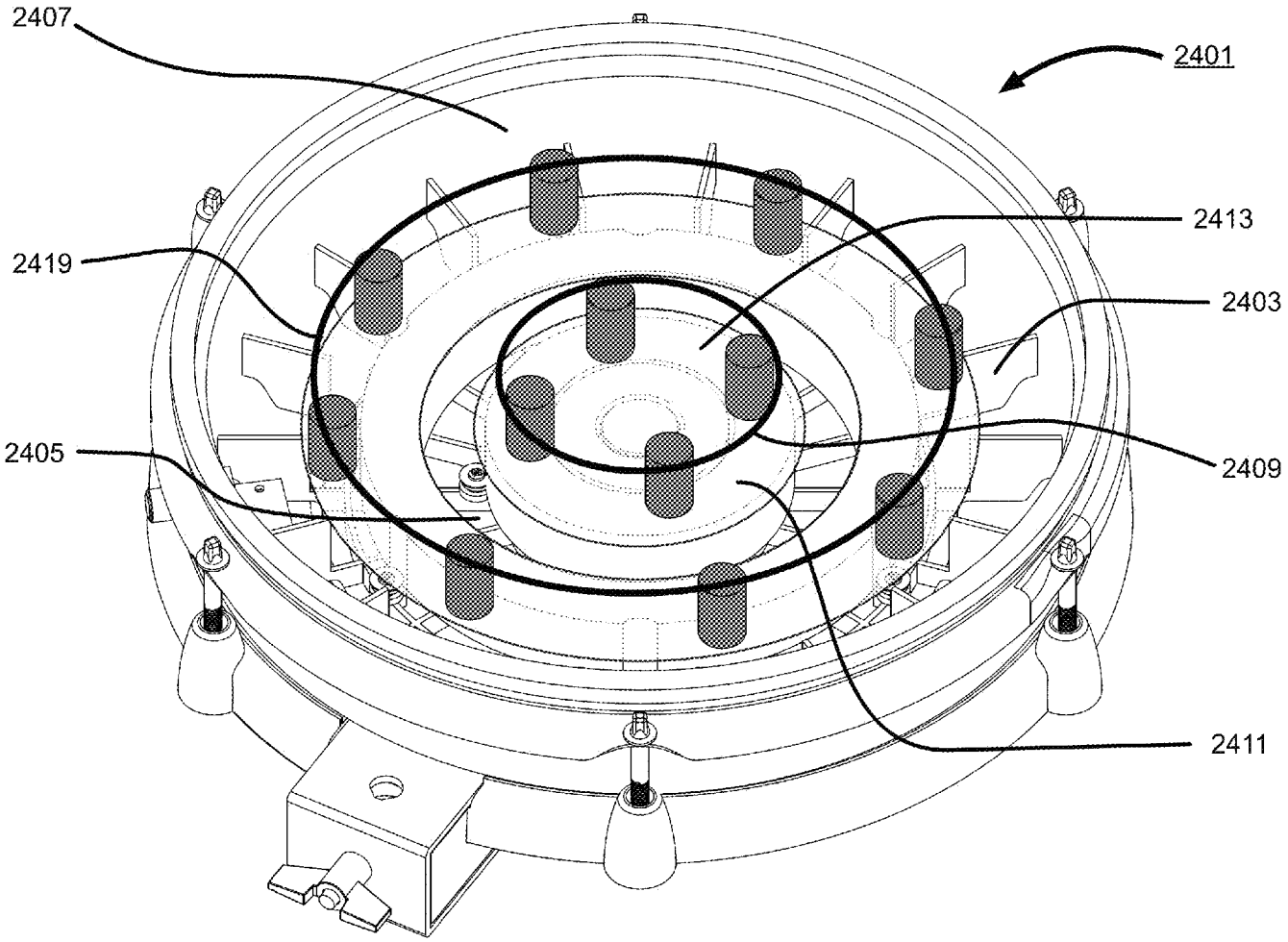
FIG. 24 is an exemplary image of two sensors inside an electronic percussion instrument, consistent with some of the embodiments of the present disclosure.

FIG. 24 is an exemplary image of two sensors inside an electronic percussion instrument, consistent with some embodiments of the present disclosure.

Electronic percussion instrument 2401 may comprise one or more flanges 2403 extending from sensor enclosure 2405 to the perimeter of the interior of shell 2407.

Sensor enclosure 2405 can comprise sensor 2409, dampening material 2411, and plate 2413. Sensor 2409, dampening material 2411, and plate 2413 can be composed of the same materials as sensor 601, dampening material 711, and plate 707 respectively. Sensor 2409, dampening material 2411, and plate 2413 can be arranged the same way sensor 309, dampening material 311, and plate 313 can be arranged within sensor enclosure 305.

Sensor 2409 can have a circular shape. In some embodiments sensor 2409 can have a triangular, quadrilateral, or square shape.

Sensor 2419 can have a ring shape. In some embodiments sensor 2419 can have a triangular, quadrilateral, or square shape.

In the preceding specification, the embodiments have been described with reference to specific exemplary embodiments. The specification and drawings are accordingly to be regarded as illustrative rather than restrictive sense. Other embodiments of the present disclosure may be apparent to those skilled in the art from consideration of the specification and practice of the invention disclosed herein.

What is claimed is:

1. An electronic percussion instrument comprising:

an electromechanical sensor configured to sense an impact received within a predefined impact region of the semi-permeable playing surface, and to generate an electrical signal associated with the sensed impact, wherein the generated electrical signal is equivalent in magnitude to any other electrical signal generated by the sensor in response to any other received impact within the predefined impact region;

an acoustic noise reducing cavity; and a semi-permeable playing surface configured to receive an impact, and comprising connected strands of ductile material covering the acoustic noise reducing cavity.

2. The electronic percussion instrument of claim 1, wherein the cavity is an anechoic chamber.

3. The electronic percussion instrument of claim 1, wherein the strands of the semipermeable playing surface are arranged to minimize the production of acoustic waves within the acoustic cavity, in response to an impact on the playing surface.

4. The electronic percussion instrument of claim 3, wherein the arrangement of the strands of the semi-permeable playing surface forms a lattice.

5. The electronic percussion instrument of claim 1, wherein the shape of the predefined impact region of the semi-permeable playing surface is determined by a user.

6. The electronic percussion instrument of claim 1, wherein the size of the predefined impact region of the semi-permeable playing surface is determined by a user.

7. The electronic percussion instrument of claim 1, wherein the predefined impact region of the semi-permeable playing surface comprises the entire area of the semi-permeable playing surface, or any portion thereof.

8. The electronic percussion instrument of claim 1, wherein the electromechanical sensor further comprises a plurality of shock absorbing posts, a plate, and one or more electromechanical transducers.

9. The electronic percussion instrument of claim 8, wherein the superior end of the shock absorbing posts are in contact with the inferior end of the semi-permeable playing surface, the inferior end of the shock absorbing posts are in contact with the superior end of the plate, and the inferior end of the plate is in contact with the superior end of the one or more electromechanical transducers.

10. The electronic percussion instrument of claim 1, wherein the magnitude of the electrical signal is determined using: the magnitude of the velocity, the force, or a combination thereof, of the impact sensed by the electromechanical sensor.

11. The electronic percussion instrument of claim 9, wherein the shock absorbing posts are on the perimeter of the plate.

12. The electronic percussion instrument of claim 11, wherein the plate has a quadrilateral shape, and there is a shock absorbing post at each right angle of the plate.

13. The electronic percussion instrument of claim 11, wherein the plate has an elliptical shape, and there are a plurality of shock absorbing posts along the perimeter of the plate.

14. The electronic percussion instrument of claim 11, wherein the number and location of shock absorbing posts is based on a user playing style.

15. An electronic percussion instrument system comprising:

an acoustic noise reducing cavity;

a semi-permeable playing surface comprising connected strands of ductile material covering the acoustic noise reducing cavity, wherein a superior end of the semi-permeable playing surface is configured to receive an impact from a user;

one or more plates;

a plurality of shock absorbing posts communicatively coupled to the semipermeable playing surface and the one or more plates, and configured to transfer a force of the impact from the semi-permeable playing surface to the plates;

one or more electromechanical transducers, configured to sense the force of the impact transferred to the one or more plates, and to generate an electrical signal with a magnitude equivalent to the magnitude of the force of the impact, wherein at least one inferior end of the one or more transducers are communicatively coupled to at least one superior end of the one or more plates.

16. The electronic percussion instrument system of claim 15, wherein the one or more electromechanical transducers are vertically cascaded.

17. The electronic percussion instrument system of claim 15, wherein the electromechanical transducers are concentrically oriented with respect to one another.

18. The electronic percussion instrument system of claim 15, further comprising an electromechanical transducer enclosure configured to reflect acoustic waves, within the acoustic noise reducing cavity, away from the one or more electromechanical transducers.

19. A method of generating an audio signal in an electronic percussion instrument system, the method comprising:

receiving an impact on a playing surface covering an acoustic cavity of an electronic percussion instrument, and transferring a force of the impact to one or more shock absorbing posts communicatively coupled to the playing surface;

transferring the force of the impact received at the shock absorbing posts to one or more plates communicatively coupled to the shock absorbing posts;

transferring the force of the impact received at the one or more plates to one or more electromechanical transducers communicatively coupled to the one or more plates; and generating an electrical signal by the one or more electromechanical transducers, in response to the received impact, wherein the electrical signal is equivalent in magnitude to any other electrical signal generated by the one or more electromechanical transducers in response to any other received impact within a predefined impact region of the playing surface.

* * * * *